US010661567B2

(12) United States Patent
Cumbie et al.

(10) Patent No.: US 10,661,567 B2
(45) Date of Patent: May 26, 2020

(54) PRINTHEADS AND METHODS OF FABRICATING A PRINTHEAD

(71) Applicant: Hewlett-Packard Development Company, L.P., Houston, TX (US)

(72) Inventors: Michael W. Cumbie, Corvallis, OR (US); Chien-Hua Chen, Corvallis, OR (US); Mark H. MacKenzie, Vancouver, WA (US); Garrett E. Clark, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,848

(22) PCT Filed: Oct. 26, 2015

(86) PCT No.: PCT/US2015/057389
§ 371 (c)(1),
(2) Date: Jan. 30, 2018

(87) PCT Pub. No.: WO2017/074302
PCT Pub. Date: May 4, 2017

(65) Prior Publication Data

US 2018/0222201 A1 Aug. 9, 2018

(51) Int. Cl.

| | |
|---|---|
| ***B41J 2/16*** | (2006.01) |
| ***B41J 2/155*** | (2006.01) |
| ***B41J 2/175*** | (2006.01) |

(52) U.S. Cl.
CPC ..... *B41J 2/1637* (2013.01); *B41J 2/155* (2013.01); *B41J 2/16* (2013.01); *B41J 2/1623* (2013.01);

(Continued)

(58) Field of Classification Search
CPC ... B41J 2/1637; B41J 2/155; B41J 2/16; B41J 2/1623; B41J 2/1632; B41J 2/1635; B41J 2/175
See application file for complete search history.

(56) References Cited

U.S. PATENT DOCUMENTS

| | | | |
|---|---|---|---|
| 6,764,165 | B2 | 7/2004 | Aschoff et al. |
| 7,585,049 | B2 | 9/2009 | Keenan et al. |

(Continued)

FOREIGN PATENT DOCUMENTS

| | | |
|---|---|---|
| CN | 1286172 | 3/2001 |
| EP | 1080907 | 7/2001 |

(Continued)

OTHER PUBLICATIONS

Matsushita, N. et al., "Elaborate Precision Machining Technologies for Creating High Added Value at Low Cost", Fujitsu Sci. Tech. J., 43,1, p. 67-75, Jan. 2007.

*Primary Examiner* — Jason S Uhlenhake
(74) *Attorney, Agent, or Firm* — Hanley, Flight & Zimmerman LLC

(57) ABSTRACT

Printheads and methods of fabricating printheads are disclosed. An example printhead includes a substrate and a printhead die disposed on a surface of the substrate, where a top surface of the printhead die projects a first distance from the surface of the substrate. The example printhead also includes a barrier at least partially surrounding the printhead die. A top surface of the barrier projects a second distance from the surface of the substrate, where the first distance is less than the second distance.

11 Claims, 10 Drawing Sheets

(52) U.S. Cl.
CPC ..... *B41J 2/1632* (2013.01); *B41J 2/1635* (2013.01); *B41J 2/175* (2013.01); *B41J 2202/20* (2013.01)

(56) References Cited

U.S. PATENT DOCUMENTS

| | | | | |
|---|---|---|---|---|
| 7,591,535 | B2 | 9/2009 | Nystrom et al. | |
| 8,702,200 | B2 | 4/2014 | Choy | |
| 2002/0175967 | A1 | 11/2002 | Tsuchii | |
| 2002/0180825 | A1 | 12/2002 | Buswell et al. | |
| 2004/0095422 | A1 | 5/2004 | Eguchi et al. | |
| 2012/0113189 | A1 | 5/2012 | Kobayashi et al. | |
| 2013/0083120 | A1* | 4/2013 | Choy ..... | B41J 2/16505 347/29 |

FOREIGN PATENT DOCUMENTS

| | | |
|---|---|---|
| WO | WO-2014133633 | 9/2014 |
| WO | WO-2015094161 | 6/2015 |
| WO | WO-2015116025 | 8/2015 |

* cited by examiner

PRINTHEADS AND METHODS OF FABRICATING A PRINTHEAD

BACKGROUND

Printing devices include a printhead having a number of printhead dies that eject fluid (e.g., ink) onto a substrate (e.g., a piece of paper) to form an image. A printhead may be implemented as an ink pen or print bar. A printhead die is coupled to a surface of a printhead substrate or molding. The printhead die includes ejection elements for ejecting the fluid. Fluid flows to the ejector elements of the printhead die via slots formed in the printhead substrate between opposite sides of the substrate.

Figure 1:
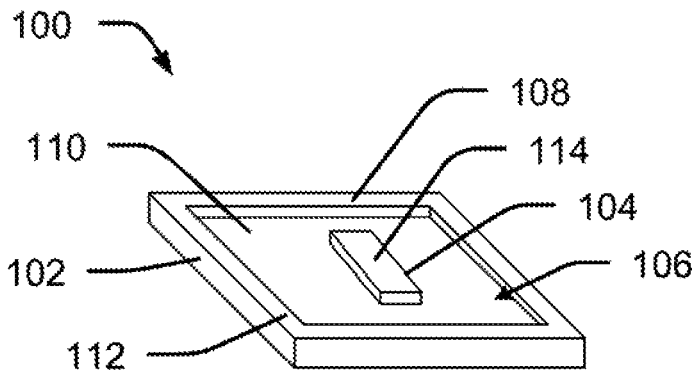
FIG. 1 illustrates an example printhead constructed in accordance with the teachings of this disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part indicates that there is no intermediate part between the two parts.

DETAILED DESCRIPTION

In general, a printhead, which may be implemented as a pen (e.g., inkjet cartridges) or a print bar, includes a printhead substrate carrying one or more printhead dies that operate to eject fluid (e.g., ink) onto a target surface (e.g., a substrate such as a piece of paper). One or more channels are formed in the printhead substrate that supply fluid to the one or more printhead dies. In known printheads, the printhead die(s) are embedded in a top surface of the printhead substrate such that a front face of the printhead die(s) are exposed outside of the top surface of the printhead substrate and a back part of the printhead die(s) are covered in the printhead substrate. In some examples, the top surface of the printhead substrate includes other components such as wires, traces and/or other circuitry components for operating the printhead die(s). As a result, when the top surface of the printhead is placed onto a support surface, the printhead die(s) and associated components may be damaged.

Some known pens or print bars are shipped with tape over the top surface of the printhead substrate (and, thus, the printhead die(s)) to protect the printhead die(s) and associated components. However, when the tape is removed, the tape may (unintentionally) remove the printhead die(s) and/or associated components from the top surface of the printhead substrate, thereby rendering the structure defective and/or inoperative. In other known pens or print bars, a cap is provided that covers the top surface printhead substrate during shipping. However, the underside of the cap may come into contact with the printhead die(s) and associated components, thereby possibly damaging the printhead die and/or associated components. Other known caps include ridges and raised features that are designed to contact the printhead substrate around the printhead die(s). These caps are costly to manufacture as they require intricate features formed in the underside of the cap.

Disclosed herein are example printheads, and methods of constructing printheads, having one or more recessed and/or proud (e.g., raised) features formed in or on the printhead substrate to protect the printhead die(s) and/or associated component(s) attached thereto. The example recesses and/or proud features provide protection from drop and/or handling damage. In some disclosed examples, a printhead die is coupled to (e.g., molded into, embedded in) a lower surface (e.g., a printhead surface) of the printhead substrate defined by a recess formed in a top surface of a printhead substrate. In some examples, the recess forms a barrier (e.g., a raised lip, a proud feature, a guard rail, a proud ring, a ridge, etc.) of the printhead substrate (e.g., in the mold compound that becomes the printhead substrate). In some examples, the barrier surrounds at least a portion of the recess and, thus, the printhead die coupled thereto. In some disclosed examples, the barrier extends or projects from the lower surface (e.g., the printhead surface) at least as far as, and potentially beyond, the face or top surface of the printhead die. As a result, if the printhead is placed dies-down on a flat supporting surface (e.g., with the printhead die(s) facing the supporting surface), the top surface of the barrier separates the printhead die from the supporting surface such that the die does not contact the supporting surface. As a result, the surface(s) of the barrier(s) prevent damage to the die(s) that might otherwise be caused by contact with the supporting surface. In some examples, multiple printhead dies are attached to the lower surface. In some examples, multiple recesses are formed in the top surface of the printhead substrate to protect corresponding ones of the dies.

In some examples, similar to protecting the printhead die(s) from a supporting surface (e.g., a table), the barrier also protects against a substrate (e.g., a piece of paper) from crashing into the printhead surface and damaging the printhead die(s) and/or associated component(s). Additionally or alternatively, in some examples, the one or more recesses in the top surface of the printhead substrate form one or more isolation rails or ridges between adjacent recesses carrying the printhead die(s). The recesses and ridges form isolated fluid slot regions (e.g., defined by the respective recesses) that prevent leakage of fluid between adjacent recesses (e.g., where adjacent channels and corresponding printhead die(s) are disposed).

In some examples, the disclosed barrier protects the printhead surface (e.g., the lower surface(s) in the recess(s) carrying the one or more printhead die(s)) in the event the printhead is placed face down (i.e., die surface down) on a hard surface. This is particularly important when considering customer installable ink pens and print bars, which are typically handled by end users. The printhead die(s) are extremely fragile and sensitive. For example, in some instances, the printhead die(s) may be implemented as silicon microelectromechnical system (MEMS) dies. Contact with a hard surface and/or debris between a hard surface and the printhead die(s) may scratch, damage or otherwise compromise the integrating of the sensitive printhead die surface(s).

In some examples, the printhead die(s) include one or more actuators, nozzles, valves, channels, sensors, etc. In some examples, the printhead die(s) may be implemented as a micro device or a sliver. As used herein, a micro device means a device having one or more exterior dimensions less than or equal to about 30 mm. A micro device may include any mechanical, electrical or MEMS device. As used herein, a sliver or die sliver means a thin micro device having a ratio of length to width (L/W) of at least three.

Example printheads disclosed herein enable integrated cap solutions that can be more easily manufactured and used to seal the example printheads. For example, the barrier formed on the printhead substrate can be used as a sealing edge to which the cap can be attached. In particular, because the barrier extends from the printhead surface (i.e., the lower surface defined by the one or more recesses and carrying the one or more printhead die(s)) further than the printhead die(s) and/or the associated component(s), a substantially flat or planar cap can be placed over the printhead substrate. Such a cap can contact the upper surface(s) of the barrier(s) without contacting the die(s). A flat or planar cap is relatively cheap to manufacture. In the past, specialized caps having intricate features to engage the printhead surface between the printhead dies were needed. Such specialized caps are more expensive to manufacture than the flat or planar caps that may be used with the printheads disclosed herein. Thus, lower shipping and handling costs can be achieved with the example printheads disclosed herein. Further, in some examples, one or more ridges or isolation rails are formed between recesses having the one or more printhead die(s). Further, the ridges protect against fluid transfer between adjacent recesses (and, thus, adjacent printhead dies). Thus, the recessed and/or raised features of some example printheads enable better printhead shipping caps than prior printheads.

Additionally or alternatively, in some examples, the printhead can be sealed with nozzle tape that engages the barrier(s) of the printhead substrate. The barrier(s), which is/are spaced from the printhead surface higher than the printhead die(s), prevents the tape from contacting the printhead die(s) and, thus, substantially reduces (e.g., eliminates) the risk of damaging the printhead die(s) when removing the tape. In contrast, known printheads exposed electrical interconnection and die(s) to the tape, thereby raising the possibility of damage during tape removal.

Disclosed herein are example printheads that include a substrate and a printhead die disposed on a surface of the substrate. A top surface of the printhead die projects a first distance from the surface of the substrate. The disclosed example printheads also include a barrier at least partially surrounding the printhead die. A top surface of the barrier projects a second distance from the surface of the substrate, where the first distance is less than the second distance.

In some disclosed examples, the difference between the first distance and the second distance is about 10 micrometers to about 500 micrometers. In some disclosed examples, the first printhead die is partially embedded in the substrate. In some disclosed examples, the printhead die is a first printhead die, and the example printhead further includes a ridge extending from the substrate and a second printhead die disposed on the ridge. In some such examples, a top surface of the second printhead die is spaced a third distance from the surface of the substrate, where the third distance is less than the second distance. In some such disclosed examples, the first printhead die is a first microelectromechanical systems (MEMS) device and the second printhead die is a second MEMS device different than the first MEMS device. In some examples, the printhead further includes a cap having a substantially flat bottom surface. When the cap is coupled to the top surface of the barrier, the bottom surface of the cap is spaced apart from the top of the printhead die.

Disclosed herein are example printheads that include a substrate having a first recess and a second recess, a first printhead die in the first recess, a second printhead die in the second recess, and a ridge located between the first recess and the second recess. The ridge supports the substrate on a surface while preventing the first and second printhead dies from contacting the surface.

In some disclosed examples, at least one of the first printhead die or the second printhead die is partially embedded in the substrate. In some disclosed examples, the substrate includes a first channel extending from a bottom surface of the substrate to the first printhead die and a second channel extending from the bottom surface of the substrate to the second printhead die. In some disclosed examples, the first printhead die is a first MEMS device and the second printhead die is a second MEMS device different than the first MEMS device. In some disclosed examples, a top surface of the first printhead die is spaced below a top surface of the ridge by about 10 micrometers to about 500 micrometers.

Disclosed here are example methods of fabricating a printhead. Some disclosed example methods include placing a bottom of a tape on a carrier, where the carrier has a first raised feature, arranging a printhead die on the tape over the first raised feature, and compression molding a printhead substrate onto the tape and the carrier to thereby at least partially mold the printhead die into a first recess formed in an upper surface of the printhead substrate by the first raised feature of the carrier. The upper surface of the printhead substrate projects a first distance from a lower surface of the first recess, and a top surface of the printhead die projects a second distance from the lower surface of the first recess. The second distance is less than the first distance.

In some disclosed examples, the upper surface of the printhead substrate forms a barrier at least partially surrounding the printhead die. In some disclosed examples, the carrier includes a second raised feature separated from the first raised feature. In some such examples, the printhead die is a first printhead die, and the example method further includes, prior to compression molding, arranging a second printhead die on the tape over the second raised feature such that after the compression molding. The second printhead die is at least partially molded into a second recess formed in the printhead substrate by the second raised feature of the carrier. In some such examples, a top surface of the second printhead die projects a third distance from a lower surface of the second recess. In some such examples, the third distance is less than the first distance. In some disclosed examples, a corner of the first recess is chamfered.

Turning to FIG. 1, an example printhead 100 (e.g., a printhead cartridge, such as an inkjet cartridge, a pen assembly, etc., a print bar, etc.) is shown. The example printhead 100 carries one or more printhead dies, as disclosed in further detail herein, that eject fluid (e.g., ink) to form an image on a substrate (e.g., a piece of paper). In the illustrated example, the printhead 100 includes a printhead substrate 102 and a printhead die 104 that is carried by (e.g., mounted to, fixed directly or indirectly upon, embedded in, molded into) the printhead substrate 102. The printhead die 104 may be implemented as one or more micro devices that may be, for example, an electronic device, a mechanical device, or a MEMS device. The printhead die 104 may include one or more nozzles, valves, actuators, channels, sensors, etc. In some examples, the printhead die 104 is in fluid communication with a fluid supply (e.g., ink) and operates to eject the fluid onto a substrate (e.g., a piece of paper).

To protect the printhead die 104 and/or other associated printhead components (e.g., a wire connecting the printhead die 104 to a printed circuit board, a cover or encapsulation, etc.), the example printhead 100 includes a recess 106 formed in a top side or upper surface 108 of the printhead substrate 102 that defines a printhead surface or lower surface 110 where the printhead die 104 is disposed. In particular, the printhead die 104 is coupled to or molded into the lower surface 110 of the printhead substrate 102 defined by the recess 106. A barrier 112 (e.g., a raised lip, a proud feature, a guard rail, a proud ring, an extension, etc.) is formed around a perimeter or outer edge of the printhead substrate 102 and surrounds a perimeter of the lower surface 110 where the printhead die 104 and/or the other associated printhead components are disposed.

In the illustrated example, the upper surface 108 of the printhead substrate 102 (e.g., the top surface of the barrier 112) is spaced from the lower surface 110 of the printhead substrate 102. The spacing between the top surface of the barrier 112 and the lower surface 110 (e.g., the height of the barrier 112) is sufficient such that a top surface 114 of the printhead die 104 is below the top surface of the barrier 112 (e.g., the upper surface 108). In other words, the printhead die 104 projects from the lower surface 110 a distance that is less than a distance that the barrier 112 projects from the lower surface 110. As a result, if the printhead 100 is placed face down on a supporting surface (i.e., with the lower surface 110 facing the supporting surface), the top surface of the barrier 112 contacts the supporting surface and creates a gap or space between the supporting surface and the top surface 114 of the printhead die 104. In some examples, the difference between the distance that the upper surface 108 projects from the lower surface 110 and the distance that the top surface 114 of the printhead die 104 projects from the lower surface 110 is about 10 to about 500 microns or micrometers (μm). In other examples, the difference may be more or less (e.g., 5 μm, 800 μm, 900 μm, etc.). In some examples, the barrier 112 surrounds only a portion of the lower surface 110 (e.g., along one side of the lower surface 110).

Figure 2:
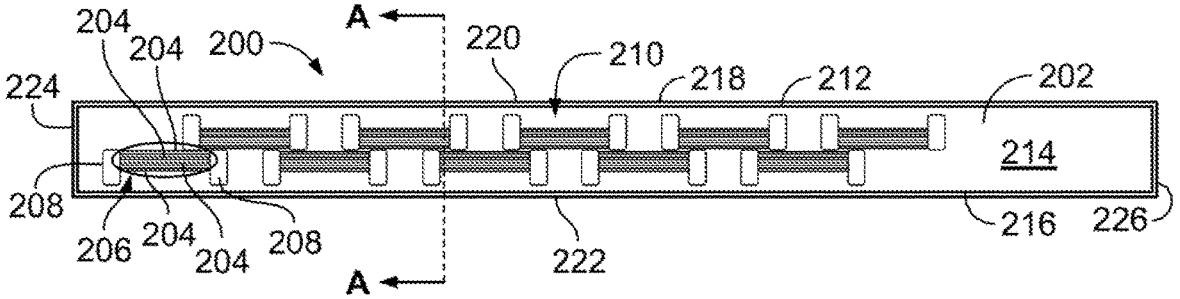
FIG. 2 is a top view of another example printhead constructed in accordance with the teachings of this disclosure.

FIG. 2 illustrates another example printhead 200 constructed in accordance with the teachings of this disclosure. In the illustrated example of FIG. 2, the printhead 200 is a print bar (e.g., a page wide print array, etc.). In the illustrated example, the printhead 200 includes a printhead substrate 202 (e.g., a mold, molding, a shroud, a panel, a body, etc.) that may be used to carry one or more printhead dies. In the illustrated example, a plurality of printhead dies 204 are disposed on the printhead substrate 202. The printhead substrate 202 is an Epoxy Mold Compound (EMC) structure, which may be constructed of, for example, a semiconductor grade epoxy, silicon such as CEL400ZHF40WG from Hitachi Chemical, a thermal set material, an electric grade thermal set epoxy, a silica filled epoxy (e.g., around 10% epoxy and 90% silica) and/or other EMC mold compounds.

In the illustrated example, the printhead dies 204 are carried by (e.g., mounted to, fixed directly or indirectly upon, embedded in, molded into) the printhead substrate 202. The printhead dies 204 may be implemented as micro devices that may be, for example, an electronic device, a mechanical device, or a MEMS device. The printhead dies 204 may include one or more nozzles, valves, actuators, channels, sensors, etc. In some examples, one or more of the printhead dies 204 are in fluid communication with a fluid supply (e.g., ink) and operate to eject the fluid onto a substrate (e.g., a piece of paper), as disclosed in further detail herein.

In the illustrated example, the printhead dies 204 are grouped together in squads 206. In the illustrated example, each of the squads 206 includes a set of four of the printhead dies 204 oriented substantially parallel to each other. However, in other example, the squads 206 may include more or fewer of the printhead dies 204 (e.g., 1, 2, 3, 5, etc.). In the illustrated example, the squads 206 are staggered along a length of the printhead 200, such that the printhead dies 204 overlap, thereby ensuring fluid can be supplied to all locations along a target substrate. However, in other examples, the squads 206 and/or the printhead dies 204 may be arranged in other configurations. In the illustrated example, forty (40) printhead dies 204 are carried by the printhead substrate 226. In other examples, more or fewer printhead dies 204 may be used. In some examples, only one printhead die 204 may be employed.

Figure 3:
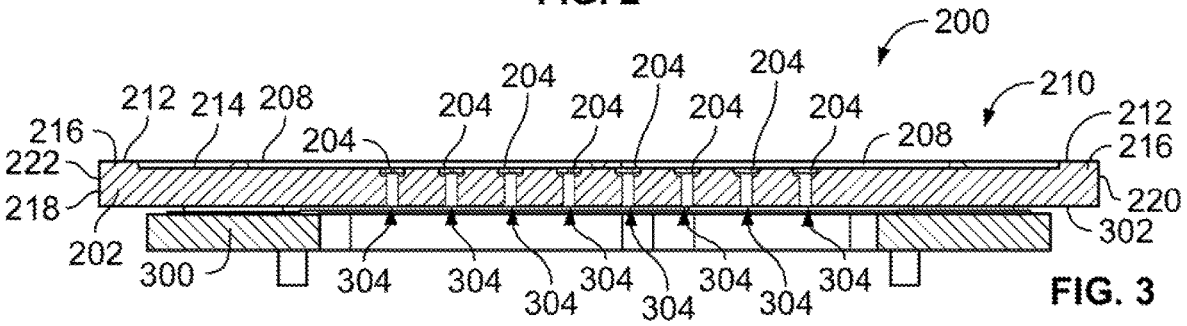
FIG. 3 is a cross-sectional view of the example printhead of FIG. 2 taken along line A-A of FIG. 2.
Figure 4:
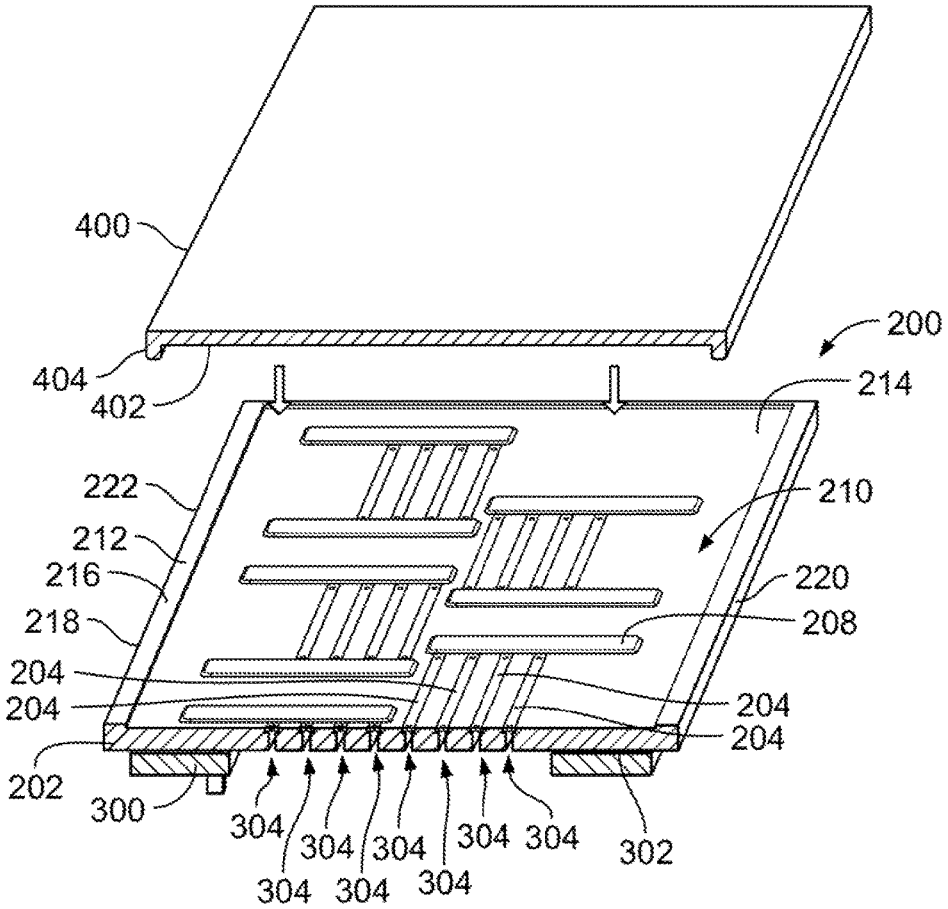
FIG. 4 is an exploded perspective view of the example printhead of FIG. 3 and an example cap.

FIG. 3 is a cross-sectional view of the example printhead 200 of FIG. 2 taken along line A-A of FIG. 2. FIG. 4 is a perspective view of the printhead 200 of FIGS. 2 and 3 illustrating the area of the cross section. As illustrated in FIGS. 3 and 4, the printhead 200 includes a printed circuit board (PCB) 300 disposed beneath the substrate 202. The PCB 300 is coupled to a bottom side 302 of the printhead substrate 202. To provide fluid (e.g., ink) to one or more of the printhead dies 204, a plurality of channels 304 (e.g., ink slots, inlets, passageways, etc.) are formed in the bottom side 302 of the printhead substrate 202. The example channels 304 extend through the printhead substrate 202 to the printhead dies 204. As illustrated in FIGS. 2, 3 and 4, a plurality of covers 208 (e.g., encapsulations, electrical covers, etc.) are disposed on opposite ends of the printhead dies 204 of the respective squads 206. The covers 208 encapsulate or cover electrical connections (e.g., wires, traces, terminals, etc.) that communicatively coupled the printhead dies 204 to the PCB 300 (FIGS. 3 and 4).

In known printheads, the printhead dies protrude or stick out from a printhead surface. In other words, a face or top surface of the printhead dies extend above a top surface of the printhead substrate. When such printheads are placed face down on a supporting surface (e.g., a table, a desk, etc.), the sensitive printhead dies will contact the support surface and may be damaged from that contact (e.g., directly by the surface, or indirectly with debris such as dust particles).

To protect the printhead dies 204 and/or other associated printhead components (e.g., the wire(s) connecting the printhead dies 204 to the PCB 300, the covers 208, etc.), the example printhead 200 of FIGS. 2-4 includes a recess 210 formed in a top side or upper surface 212 of the printhead substrate 202 that defines a printhead surface or lower surface 214 where the printhead dies 204 are disposed. In particular, the printhead dies 204 are coupled to or molded into the lower surface 214 of the printhead substrate 202, defined by the recess 210. The lower surface 214 is spaced below the upper surface 212. In the example of FIGS. 2-4, a barrier 216 (e.g., a raised lip, a proud feature, a guard rail, a proud ring, an extension, etc.) is formed around a perimeter or outer edge 218 of the printhead substrate 202. In this example, the barrier 216 surrounds a perimeter of the lower surface 214 where the printhead dies 204 and the associated printhead components are disposed.

In the illustrated example, the upper surface 212 of the printhead substrate 202 (e.g., the top surface of the barrier 216) is spaced from the lower surface 214. The spacing between the top surface of the barrier 216 and the lower surface 214 (e.g., the height of the barrier 216) is sufficient such that the top surfaces of the printhead dies 204 are below the top surface of the barrier 216 (e.g., the upper surface 212). In other words, the top surfaces of the printhead dies 204 project from the lower surface 214 a distance that is less than a distance that the barrier 216 projects from the lower surface 214. As a result, if the printhead 200 is placed face down on a supporting surface (i.e., with the lower surface 214 facing the supporting surface), the top surface of the barrier 216 contacts the supporting surface and creates a gap or space between the supporting surface and the printhead dies 204. In some examples, the difference between the distance the upper surface 212 projects from the lower surface 214 and the distance the top surfaces of the printhead dies 204 project from the lower surface 214 is about 10 to about 500 microns or micrometers (μm). In other examples, the difference may be more or less (e.g., 5 μm, 800 μm, 900 μm, etc.). In some examples, the barrier 216 is structured to extend above all the components on the printhead substrate 202. For instance, in the example of FIGS. 2-4, the covers 208 project or extend from the lower surface 214 a distance that is less than the height of the barrier 216. Therefore, the example barrier 216 of FIGS. 2-4 prevents all of the components of the printhead substrate 202 (e.g., the printhead dies 204, the covers 208 and/or other electrical or mechanical component(s) of the printhead 200) from engaging or coming in contact with the supporting surface and, thus, prevents such components from damage.

In the illustrated example, the barrier 216 extends around the outer edge 218 of the printhead substrate 202 and at least partially surrounds the printhead dies 204. In particular, the barrier 216 extends (e.g., projects) from the lower surface 214 along a first edge 220 of the printhead substrate 202, a second edge 222 of the printhead substrate 202 opposite the first edge 220, a third edge 224 of the printhead substrate 202 and a fourth edge 226 of the printhead substrate 202 opposite the third edge 224. In other examples, the barrier 216 may not encompass or surround all of the lower surface 214. For example, the barrier 216 may be formed along only one edge (e.g., the first edge 220), along two edges (e.g., the first edge 220 and the second edge 222), along two corners (e.g., between the first edge 220 and the third edge 224, and between the second edge 222 and the fourth edge 226), three corners, a portion of one of the edges, etc. of the printhead substrate 202 in such a manner that if the printhead 200 is placed face down, the barrier 216 will prevent the printhead dies 204 (an possibly other components on the printhead substrate 202) from contacting the supporting surface. In the illustrated example, the upper surface 212 of the printhead substrate 202 (e.g., the top surface of the barrier 216) is substantially parallel to the lower surface 214. In other examples, the upper surface 212 may be angled with respect to the lower surface 214. Although the printhead 200 is illustrated as a print bar having multiple printhead dies 204 in the example of FIGS. 2-4, the printhead 200 may instead be implemented as an ink supply (e.g., an ink cartridge or pen) having one printhead die 204 or multiple printhead dies 204.

In some examples, a cap may be provided to protect the printhead 200 during shipping and handling. For example, FIG. 4 illustrates an example cap 400 that may be coupled to the printhead 200. As shown in the illustrated example, the cap 400 has a substantially planar or flat (e.g., ±2 μm) bottom side 402 that engages the top surface of the barrier 216 (e.g., the upper surface 212) when the cap 400 is placed on the printhead 200. In some examples, the cap 400 has a lip or rim 404 extending downward from the bottom side 402 that can further act to seal against the outer edge 218 of the printhead substrate 202. When the cap 400 is coupled to the top surface of the barrier 216, the bottom side 402 (e.g., the bottom surface) of the cap 400 is spaced apart from the top surfaces of the printhead dies 204. In addition to or alternative to the cap 400, in some examples, a seal such as a piece of tape may be disposed over the printhead 200. The tape may be coupled (e.g., via adhesive) to the top surface of the barrier 216 and, thus, extends over the printhead dies 204 without directly contacting the printhead dies 204 and/or other sensitive printhead components. The cap 400 and/or the tape may protect the printhead dies 204 and/or other printhead components from damage during shipping, for example, and the cap 400 and/or the tape can be easily removed without damage to the printhead dies 204 and/or other associated printhead components. A similar cap and/or tape may likewise be used with the example printhead 100 of FIG. 1.

Figure 5A:
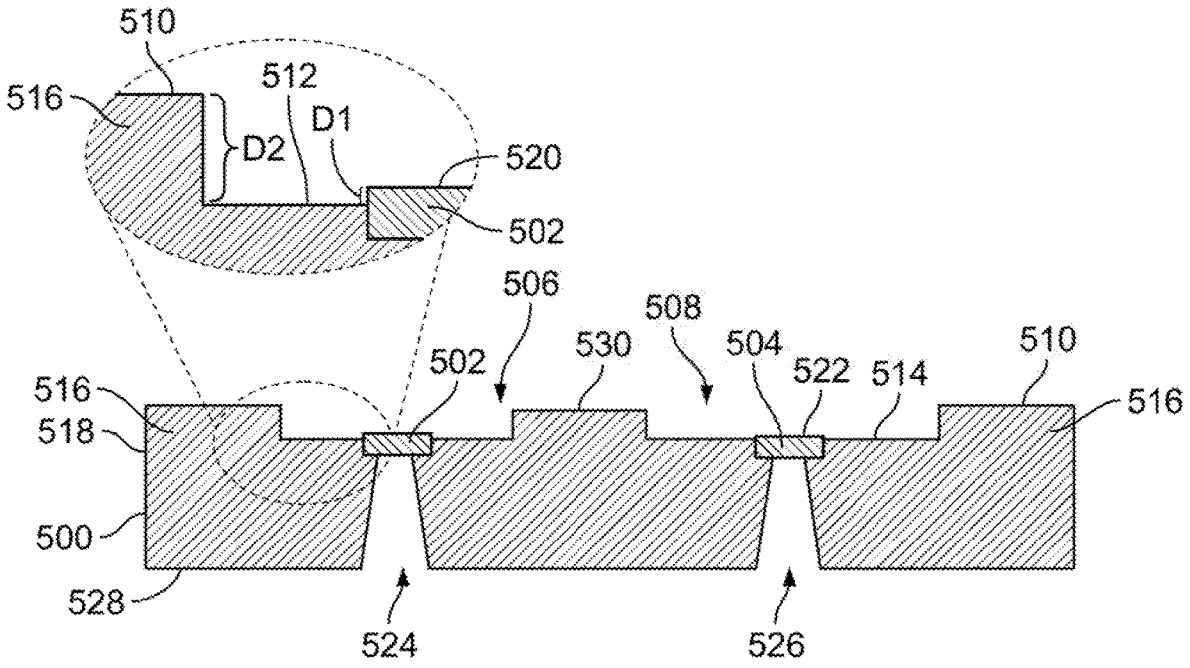
FIG. 5A is cross-sectional view of an example printhead substrate having recesses forming example raised features to protect example printhead dies.
Figure 5B:
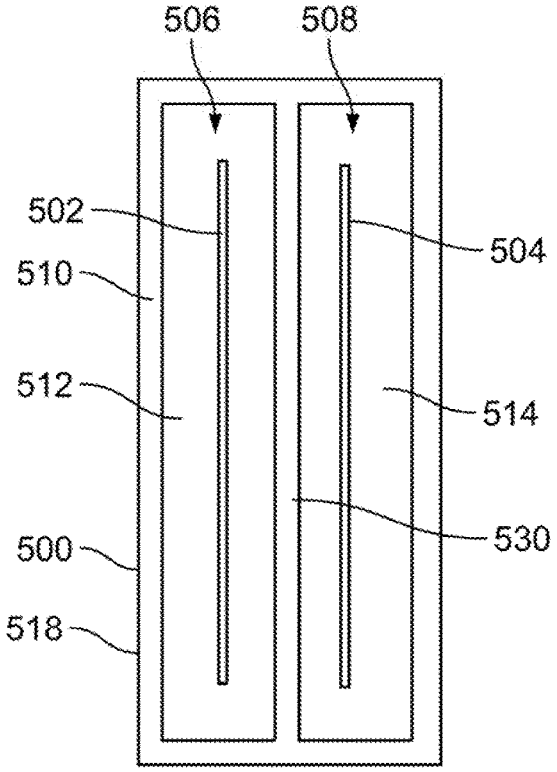
FIG. 5B is a top view of the example printhead substrate of FIG. 5A

FIG. 5A is a cross-sectional view of an example printhead substrate 500 (or portion(s)/section(s) of a printhead substrate). FIG. 5B is a top view of the example printhead substrate 500 of FIG. 5A. FIGS. 5A and 5B illustrate how one or more barriers (e.g., a guard rail, a proud ring, an isolation rail, a ridge, etc.) may be formed in or on a surface of a printhead substrate to at least partially surround one or more printhead dies and/or to isolate one or more printhead dies (e.g., to isolate adjacent printhead dies). The examples shown in connection with FIGS. 5A and 5B may be used to form similar features in the printhead substrate 102 of FIG. 1 and the printhead substrate 202 of FIG. 2, for example.

In the illustrated example of FIGS. 5A and 5B, the example printhead 500 carries two printhead dies: a first printhead die 502 and a second printhead die 504. A first recess 506 and a second recess 508 are formed in an upper surface 510 (e.g., a top surface, an EMC surface) of the printhead substrate 500. The first recess 506 has a first lower surface 512, which is spaced below the upper surface 510, and the second recess 508 has a second lower surface 514, which is spaced below the upper surface 510. In the illustrated example, the first printhead die 502 is in the first recess 506 and the second printhead die 504 is in the second recess 508. In particular, the first printhead die 502 is coupled to (e.g., disposed on, molded into, embedded in) the first lower surface 512 in the first recess 506 and the second printhead die 504 is coupled to the second lower surface 514 in the second recess 508.

In the illustrated example, the upper surface 510 defines or forms a barrier 516 (e.g., a guard rail, a raised lip, etc.) that projects or extends from the first and second lower surfaces 512, 514 and surrounds a perimeter or outer edge 518 of the printhead substrate 500. In the illustrated example, the barrier 516 projects the same distance from the first and second lower surfaces 512, 514 (i.e., the first and second lower surfaces 512, 514 are spaced the same distance below the upper surface 510 in the orientation of FIG. 5A). However, in other examples, the first lower surface 512 may be spaced from the upper surface 510 a different distance than the second lower surface 514 is spaced from the upper surface 510.

In the illustrated example, the barrier 516 is spaced apart from the first and second lower surfaces 512, 514 at least as far as a top surface 520 of the first printhead die 502 and/or a top surface 522 of the second printhead die 504. For example, as illustrated in the enlarged section view of FIG. 5A, the top surface 520 (e.g., a face) of the first printhead die 502 projects from the second lower surface 512 a distance of $D_1$. The upper surface 510 (i.e., the top surface of the barrier 516) is spaced from the first lower surface 512 a distance of $D_2$. In the illustrated example, the distance of $D_2$ is greater than the distance of $D_1$. The top surface 522 of the second printhead die 504 may likewise project from the second lower surface 514 by the distance of $D_1$. As a result, the barrier 516 projects from the first and second lower surfaces 512, 514 further than the top surfaces 520, 522 of the respective first and second printhead dies 502, 504 and, thus, protects the first and second printhead dies 502, 504 in the event the printhead substrate 500 is placed face down (e.g., with the upper surface 510 contacting a support surface).

In some examples, the difference between $D_2$ and $D_1$ (i.e., the distance between the top surface 520 of the first printhead die 502 and the upper surface 510) is about 100 to about 200 μm. In some examples, the difference between $D_2$ and $D_1$ may be more or less (e.g., about 10 to about 500 μm). In some examples, the first printhead die 502 is a first type of printhead die (e.g., a MEMS actuator for ejecting fluid) and the second printhead die 504 is a second type of printhead die (e.g., a MEMS sensor) different than the first printhead die 502.

In the illustrated example, the first and second printhead dies 502, 504 are partially disposed within (e.g., affixed to, molded into, embedded in, etc.) the respective first and second lower surfaces 512, 514 (e.g., the printhead surface) of the printhead substrate 500. However, the top surfaces 520, 522 of the respective first and second printhead dies 502, 504 are exposed or spaced above the respective first and second lower surfaces 512, 514. In other examples, the top surfaces 520, 522 may be spaced more or less from the respective first and second lower surfaces 512, 514 (e.g., even with, above or below). Thus, in some examples, the top surfaces 520, 522 of the respective first and second printhead dies 502, 504 may be flush or substantially even with the respective first and second lower surfaces 512, 514. In the illustrated example, the first and second printhead dies 502, 504 are in fluid communication with respective channels 524, 526 (e.g., ink channels) formed in the printhead substrate 500. The channels 524, 526 extend into a bottom side or surface 528 of the printhead substrate 500 from which they can source ink or other fluid from one or more reservoirs.

In addition to, or as alternative to forming the barrier 516, an isolation rail or ridge 530 may be located on the printhead substrate 500 between the first and second printhead dies 502, 504 (e.g., between the first and second channels 524, 526). In the illustrated example, the ridge 530 is located between the first recess 506 and the second recess 508. The first and second recesses 506, 508, defined between the barrier 516 and the ridge 530, form fluid slot regions (e.g., ink slot regions). Similar to the barrier 516, the upper surface of the ridge 530 is separated from the first surface 512 and/or the second surface 514 by the distance of $D_2$. Therefore, the ridge 530 projects from the first and second lower surfaces 512, 514 further than the top surfaces 520, 522 of the respective first and second printhead dies 502, 504. The ridge 530 supports the substrate 500 on a surface while preventing the first and second printhead dies 502, 504 from contacting the surface. In some examples, the ridge 530 prevents fluid (e.g., ink) from potentially leaking from one of the channels 524, 526 to the other one of the channels 524, 526 (e.g., by passing from one of the recesses 506, 508 to the other one of the recesses 506, 508, during printing or other fluid ejection operations, during shipping and/or when a cap or tape is placed over the printhead substrate 500).

In the illustrated example of FIGS. 5A and 5B, the upper surface 510 of the printhead substrate 500 at the ridge 530 is separated from the first and second lower surfaces 512, 514 the distance of $D_2$ (i.e., the same distance as the upper surface 510 of the barrier 516). For example, the top surface 520 of the first printhead die 502 and/or the top surface 522 of the second printhead die 504 may be spaced below the top surface of the ridge by about 10 to about 500 μm. However, in other examples, the ridge 530 may project from the first and second lower surfaces 512, 514 a different distance than the barrier 516. An example technique for forming the barrier 516 and/or the ridge 530 of FIGS. 5A and 5B may be used to similarly form the barrier 216 and/or a ridge between two of the example printhead dies 204 of the example printhead 200 in FIG. 2.

Figure 6:
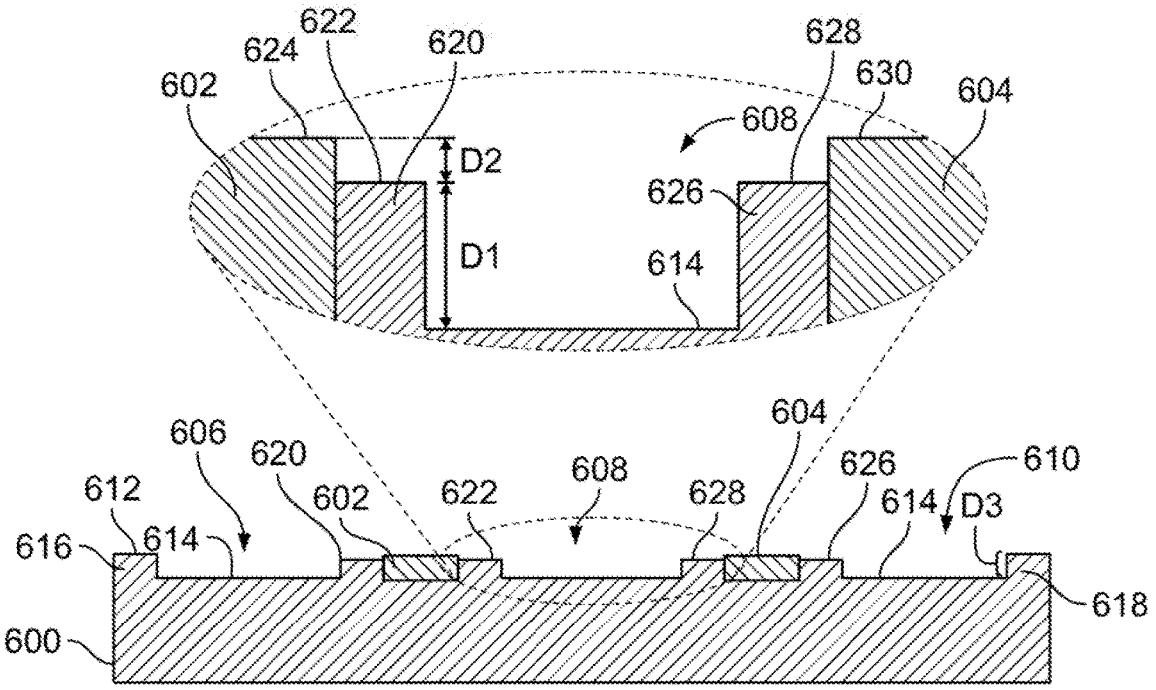
FIG. 6 is cross-sectional view of an example printhead substrate having example recesses forming example raised features carrying example printhead dies.

FIG. 6 is a cross-sectional view of another example printhead substrate 500 (or portion(s)/section(s) of a printhead substrate). FIG. 6 illustrates another manner in which one or more barriers (e.g., a guard rail, a proud ring, and isolation rail, a ridge, etc.) may be formed in or on a top surface of a printhead substrate. The examples disclosed in connection with FIG. 6 may be used to form similar features in the printhead substrate 102 of FIG. 1 and the printhead substrate 202 of FIG. 2, for example.

In the illustrated example of FIG. 6, the example printhead substrate 600 carries two printhead dies: a first printhead die 602 and a second printhead die 604. A first recess 606, a second recess 608 and a third recess 610 are formed in an upper surface 612 (e.g., a top surface, an EMC surface) of the printhead substrate 600. Each of the first, second and third recess 606, 608, 610 has a lower surface 614, which is spaced below the upper surface 612. In the illustrated example, the upper surface 612 defines or forms a barrier 616 (e.g., a proud ring) extending above the lower surface 614 in the orientation of FIG. 6. In this example, the barrier 616 surrounds at least a portion of a perimeter or edge 618 of the printhead substrate 600. In the illustrated example, the upper surface 612 of the substrate 600 (i.e., the top surface of the barrier 616) is spaced further above the lower surface 614 than the top surfaces of the first and second printhead dies 602, 604.

In the illustrated example, a first ridge 620 (e.g., a rail, an extension, a protrusion, a raised feature, etc.) is located on the substrate 600 between the first and second recesses 606, 608 (e.g., the first ridge 620 extends from the substrate 600). The first printhead die 602 is disposed on or coupled to (e.g., affixed to, molded into, embedded in, etc.) and extends from the first ridge 620. In particular, the first printhead die 602 is partially embedded in a first top surface 622 of the first ridge 620. As illustrated in the enlarged view in FIG. 6, a top surface 624 of the first printhead die 602 is spaced from the first top surface 622 of the first ridge 620. The first top surface 622 of the first ridge 620 is spaced above (e.g., projects from) the lower surface 614 by a distance of $D_1$, and the top surface 624 of the first printhead die 602 is spaced above (e.g., projects from) the first top surface 622 of the first ridge 620 by a distance of $D_2$. Therefore, the top surface 624 of the first printhead die 602 is spaced above the lower surface 614 of the printhead substrate 600 by a distance of $D_1+D_2$. In the illustrated example, the top surface of the barrier 616 (e.g., the upper surface 612) is spaced above (e.g., projects from) the lower surface 614 by a distance of $D_3$. In the illustrated example, the distance of $D_3$ is greater than the distance of $D_1+D_2$. As a result, the barrier 616 projects from the lower surface 614 further than the top surface 624 of the first printhead die 602. In this manner, the barrier 616 protects the first printhead die 602 in the event the printhead substrate 600 is placed face down (e.g., with the upper surface 612 contacting a supporting surface). In some examples, the difference between the distance of $D_3$ and the total of the distances $D_1+D_2$ (i.e., the distance between the top surface 624 of the first printhead die 602 and the upper surface 612) is about 10 μm to about 500 μm. In other examples, the difference between the distance of $D_3$ and the total of the distances $D_1+D_2$ may be more or less (e.g., 100-200 μm).

In the illustrated example, a second ridge 626 is formed between the second and third recesses 608, 610. The second printhead die 604 is disposed on or coupled to the second ridge 626 and extends from the second ridge 626. In particular, the second printhead die 604 is embedded in a second top surface 628 of the second ridge 622. As shown in the enlarged view in FIG. 6, a top surface 630 of the second printhead die 604 is spaced above (e.g., projects from) the second top surface 628 of the second ridge 626. In the illustrated example, similar to the first ridge 622, the second ridge 626 projects from the lower surface 614 the distance of $D_1$. Additionally, similar to the first printhead die 602, the top surface 630 of the second printhead die 604 is spaced above the second top surface 628 of the second ridge 626 by the distance of $D_2$. Therefore, the barrier 616 projects from the lower surface 614 further than the top surface 630 of the second printhead die 604. In other examples, the first ridge 620 and the second ridge 626 may project from the lower surface 614 different distances than each other. Additionally or alternatively, in some examples, the top surface 624 of the first printhead die 602 may be spaced from the first top surface 622 of the first ridge 620 a different distance than the top surface 630 of the second printhead die 604 is spaced from the second top surface 628 of the second ridge 626. In other words, in some examples, the first and second ridges 620, 626 may be spaced from the lower surface 614 different distances than each other and/or the first and second printhead dies 602, 604 may be spaced from the respective first and second ridges 620, 626 different distances than each other. In some examples, one or more channels (e.g., ink channels) may be formed in the printhead substrate 600 to fluidly couple the first printhead die 602 and/or the second printhead die 604 to one or more fluid supply (e.g., an ink supply).

Figure 7:
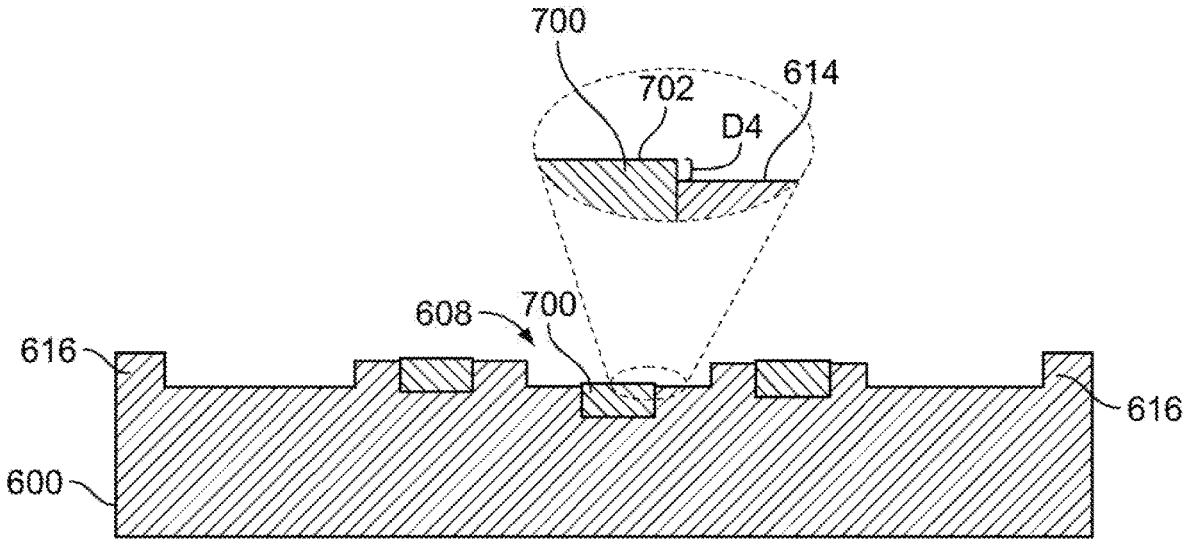
FIG. 7 illustrates the example printhead substrate of FIG. 6 having an additional example printhead die which is disposed in an example recess and which is offset from the example printhead dies carried by the example raised features.

In some examples, only one ridge (e.g., the first ridge 620) may be formed in or on the printhead substrate 600. In other example, more than two ridges may be formed in or on the printhead substrate 600. In some examples, more than one printhead die may be coupled to the same ridge (e.g., two printhead dies coupled to the top surface 628 of the second ridge 626). In other examples, one or more printhead dies may be coupled to the lower surface 614 of the printhead substrate. For example, in some instances, not all of the printhead dies are spaced the same distance from a target substrate (e.g. a piece of paper). In particular, in some examples, one or more printhead die(s) may have a different field depth or distance than others of the printhead die(s). In such examples, it may be desirable to space the printhead die(s) at different distances from the target substrate. For example, FIG. 7 illustrates a third printhead die 700 coupled to the example printhead substrate 600. In the illustrated example, the third printhead die 700 is coupled to (e.g., affixed to, molded into, embedded in, etc.) the lower surface 614 in the second recess 608. In some examples, the first printhead die 602 is a first type of printhead die (e.g., a MEMS actuator for ejecting fluid) and the third printhead die 700 is a second type of printhead die (e.g., a MEMS sensor) different than the first printhead die 602. In the illustrated example, a top surface 702 of the third printhead die 700 is spaced above the lower surface 614 a distance of $D_4$, which is less than the distance of $D_3$ (FIG. 6). Therefore, the barrier 616 extends further from the lower surface 614 than the barrier 616 extends from the top surface 702 of the third printhead die 700. In the illustrated example, the example recesses 606, 608, 610 and/or and the example raised features (e.g., the barrier 616, the first ridge 620 and/or the second ridge 626) of FIGS. 6 and 7 provide relatively precise offsets or depths at which the first, second and third printhead dies 602, 604, 700 can be disposed.

Figure 8:
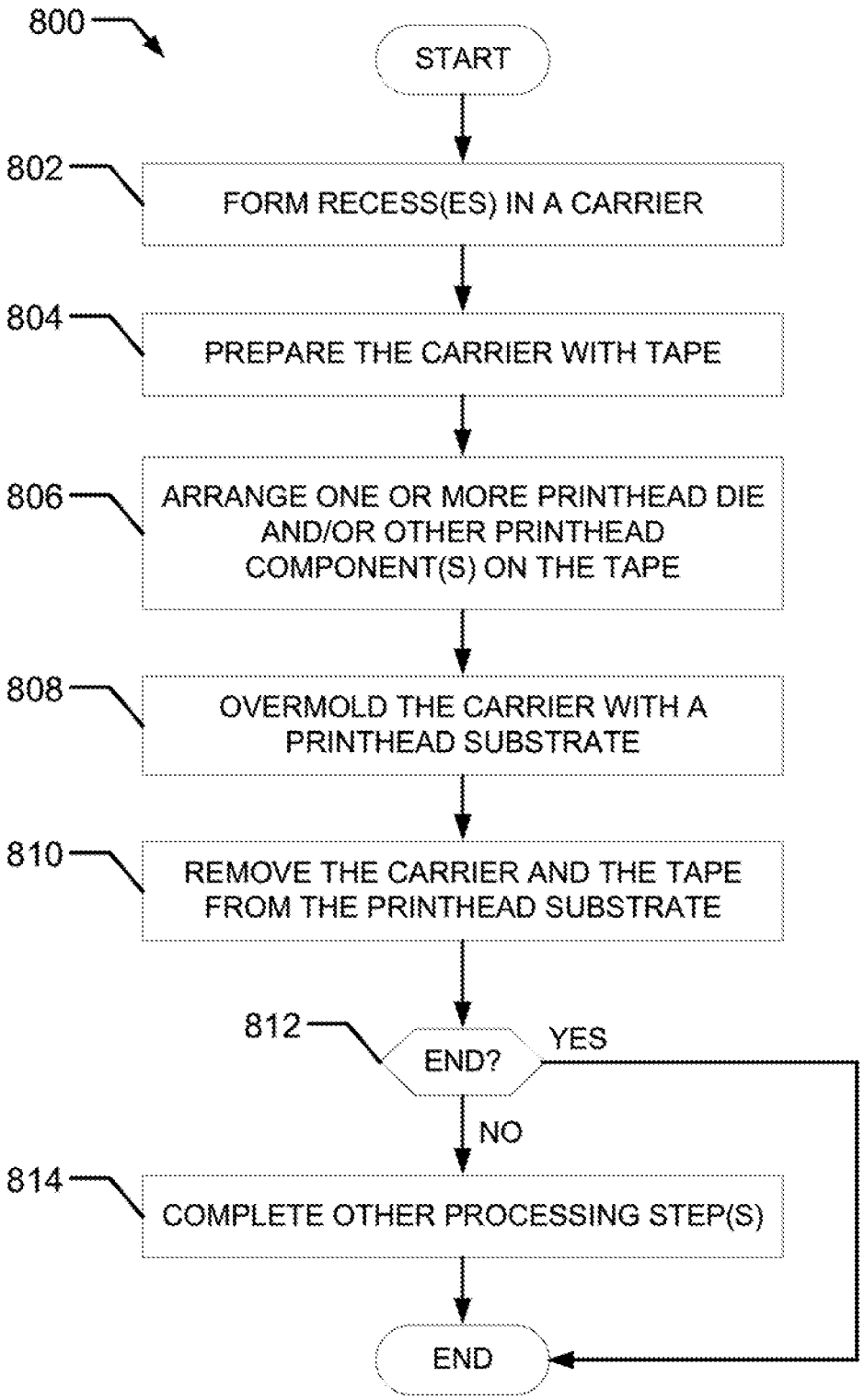
FIG. 8 is a flowchart representative of an example method of fabricating printheads disclosed herein.

FIG. 8 is a flowchart representative of an example process or method 800 for fabricating example printheads disclosed herein. The example method 800 of FIG. 8 is described in combination with FIGS. 9A-9D, which show the resulting structure from executing the example method 800 of FIG. 8. The example method 800 may be used to form one or more recesses and/or one or more raised features (e.g., a barrier, a ridge, etc.) in a printhead substrate such as, for example, the example printhead substrate 500 of FIGS. 5A and 5B.

Figure 9A:
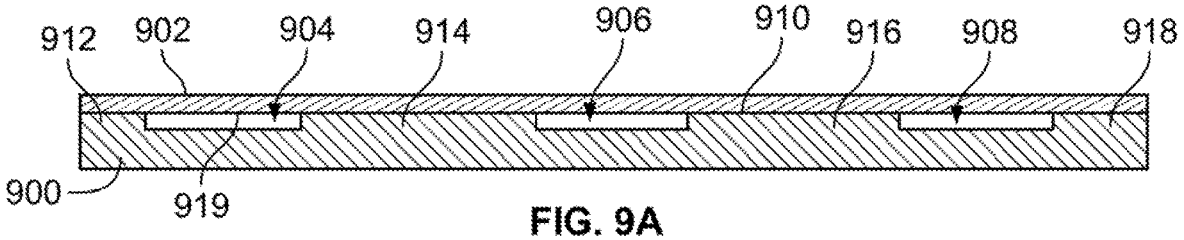
FIGS. 9A-9D illustrate an example printhead at various stages of fabrication in accordance with the example method of FIG. 8.

The example method 800 of FIG. 8 begins by forming one or more recess(es) in a carrier (block 802). For example, as illustrated in FIG. 9A, a structured carrier 900 (e.g., a chuck, a mold, etc.). In the illustrated example, the example carrier 900 includes a first recess 904, a second recess 906 and a third recess 908 formed in a top surface 910 of the carrier 900. The first, second and third recesses 904, 906, 908 may be used to form raised features (e.g., a barrier, a ridge, an isolation rail, etc.) in a surface of a printhead substrate, as disclosed in further detail herein. In other examples, the carrier 900 may include more or fewer recesses. In some examples, the first recess 904, the second recess 906 and/or the third recess 908 are machined into the top surface 910 of the carrier 900.

The example method 800 of FIG. 8 includes preparing the carrier with tape (e.g., laminate tape) (block 804). For example, as illustrated in FIG. 9A, the carrier 900 is prepared with laminate tape 902. In the illustrated example, forming the first, second and third recesses 904, 906, 908 effectively creates raised areas on the carrier 900. For example, a first raised area 912 (e.g., a raised feature) is defined adjacent the first recess 904, a second raised area 914 is defined between the first and second recesses 904, 906, a third raised area 916 is defined between the second and third recesses 906, 908, and a fourth raised area 918 is defined adjacent the third recess 908. In the illustrated example, the first, second, third and fourth raised areas 912, 914, 916, 918 are separated from each other. The first recess 904, the second recess 906 and/or the third recess 908 may extend any distance into the carrier 900. The height(s) of the first, second, third and fourth areas 912, 914, 916, 918 depend on the depths to which the first, second and third recesses 904, 906, 908 are formed.

In the illustrated example, the tape 902 is deposited (e.g., placed, laid) on the top surface 910 of the carrier 900 after the recesses are formed. In particular, a bottom side 919 of the tape 902 is placed in contact with the top surface 910 of the carrier 900 (e.g., in contact with the first, second, third and fourth raised areas 912, 914, 916, 918. In the illustrated example, the tape 902 is flush across the top surface 910 (and, thus, does not extend into the first, second and third recesses 904, 906, 908). However, in other examples, the tape 902 is deposited to follow the surface of the first recess 904, the second recess 906 and/or the third recess 908. In the illustrated example, the tape 902 is double-sided tape (e.g., each side of the tape includes an adhesive). As such, the bottom side of the tape 902 includes an adhesive (e.g., a pressure sensitive adhesive (PSA), a thermal sensitive adhesive, etc.) that couples the tape 902 to the carrier 900. In other examples (e.g., as disclosed in FIG. 10), a single-sided tape may be employed. In other examples, other types of tape such as embossed type, multi-layer tape, etc. and/or any other adhesive structure may be implemented.

Figure 9B:
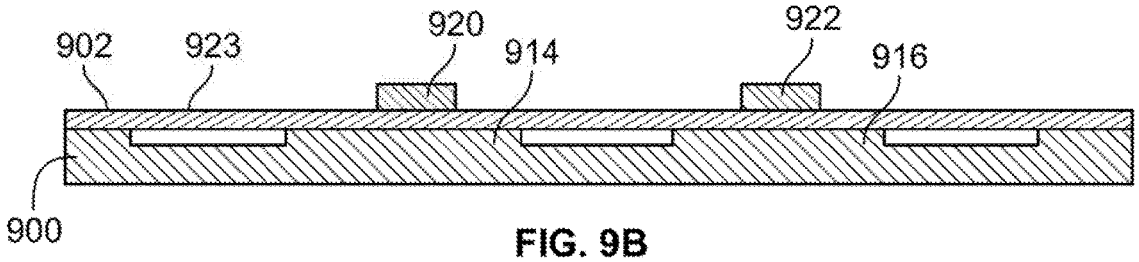

After the tape 902 is positioned on the carrier 900, one or more printhead dies (e.g., a micro device, such as a MEMS device or sliver) and/or other printhead component(s) (e.g., wiring, traces, covers, etc.) are positioned (e.g., arranged) on the tape (block 806). For example, as illustrated in FIG. 9B, a first printhead die 920 and a second printhead die 922 are arranged on the tape 902. However, in other examples, only one printhead die may be used or more than two printhead dies may be used. In the illustrated example, the first printhead die 920 is placed on a top side 923 of the tape 902 over the second raised area 914 and the second printhead die 922 is placed on the top side 923 of the tape 902 over the third raised area 916. The top side 923 of the tape 902 includes an adhesive that couples the one or more printhead dies to the tape 902 and, thus, to the carrier 900.

Figure 9C:
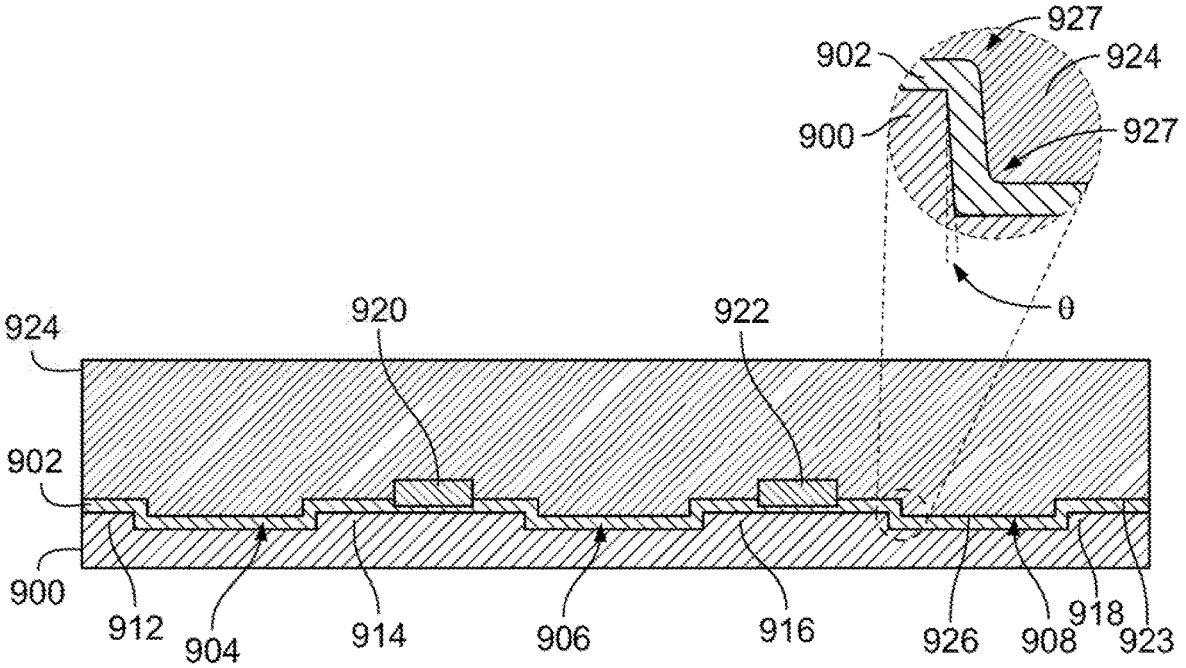

After the die(s) and/or other printhead component(s) are arranged on the tape 902, the carrier 900 is overmolded with a printhead substrate (block 808). As illustrated in FIG. 9C, the carrier 900 is overmolded by compressing a printhead substrate 924 onto the carrier 900 (e.g., in the direction of the top surface 910 (FIG. 9A)). The compression process may be performed by applying high heat and/or high pressure. As illustrated in FIG. 9C, an upper surface 926 of the printhead substrate 924 contacts the top side 923 of the tape 902. As the printhead substrate 924 is compressed, the upper surface 926 of the printhead substrate 924 moves into the first, second and third recesses 904, 906, 908 of the carrier 900. As a result, the first, second, third and fourth raised areas 912, 914, 916, 918 of the carrier 900 form recesses in the upper surface 926 of the printhead substrate 924. Additionally, the first and second printhead dies 920, 922 are pressed into the printhead substrate 924 along the recesses formed in the printhead substrate 924. In some examples, prior to overmolding the printhead substrate 924 at block 808, the upper surface 926 of the printhead substrate 924 is substantially flat or planar.

In some examples, as illustrated in the enlarged view in FIG. 9C, the tension and/or the flexibility of the tape 902 causes one or more chamfer(s) or radius(es) 927 (e.g., curved corners) to be formed in the edges of the printhead substrate 924 (e.g., on the edge(s) of the raised feature(s) and/or between the raised feature(s) and the recess(es) formed in the printhead substrate 924). In some examples, the radius(es) 927 enable the carrier 900 and/or tape 902 to be removed more easily from the printhead substrate 924. In some examples, one or more chamfer(s) or radius(es) may be formed (e.g., fabricated) into the edges/corners of the carrier 900 (e.g., one or more of the edge(s) of the first, second, third and fourth raised areas 912, 914, 916, 918 and/or between one or more of the first, second, third and fourth raised areas 912, 914, 916, 918 and/or the first, second and third recesses 904, 906, 908). In some examples, one or more other types of geometries (e.g., a square indentation, a star indentation, a circular protrusion, etc.) may be fabricated into the carrier 900, which are then formed into the surface(s) of the of the printhead substrate 924. Additionally or alternatively, in some examples one or more of the side walls of the first, second, third and fourth raised areas 912, 914, 916, 918 (e.g., the vertical wall(s) formed between an upper surface of the first, second, third and/or fourth raised areas 912, 914, 916, 918 and a lower surface of the first, second and/or third recesses 904, 906, 908) may include a draft angle θ (e.g., a taper, a relief angle, etc.). Such a draft angle θ may aid in the separation of the printhead substrate 926 from the carrier 900 and/or the tape 902. The draft angle θ may be any desired angle (e.g., 0.15°, 2°, etc.).

Figure 9D:
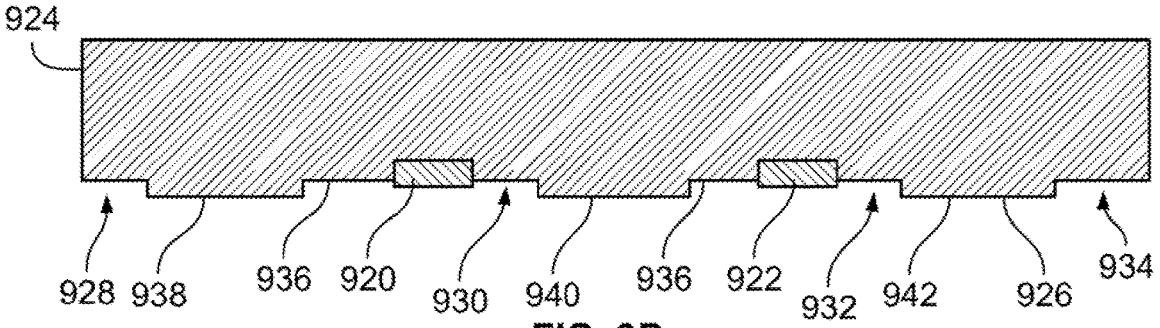

After the overmolding is complete (block 808), the carrier 900 and the tape 902 are removed from the printhead substrate 924 (block 810). FIG. 9D illustrates the printhead substrate 924 after the carrier 900 and the tape 902 have been removed. The first and second printhead dies 920, 922 remain coupled (e.g., molded into, embedded in) the printhead substrate 900. In some examples, a heating process is used to release the carrier 900 from the printhead substrate 924. For example, the carrier 900 may be heated to 180° Celsius (C) for 90 seconds.

As shown in the illustrated example of FIG. 9D, the first, second, third and fourth raised areas 912, 914, 916, 918 of the carrier 900 have formed corresponding first, second, third and fourth recesses 928, 930, 932, 934 in the upper surface 926 of the printhead substrate 924. The first, second, third and fourth recesses 928, 930, 932, 934 form a lower surface 936 (e.g., a printhead surface to which the printhead die(s) are disposed). The lower surface 936 is spaced below the upper surface 926 of first, second and third raised features 938, 940, 942. In the illustrated example, the first printhead die 920 is coupled to (e.g., at least partially molded into, embedded in, etc.) the lower surface 936 in the second recess 930 (which was formed in the upper surface 926 by the second raised area 914) and the second printhead die 922 is coupled to the lower surface 936 in the third recess 932 (which was formed in the upper surface 926 by the third raised feature 916). In the illustrated example, the first raised feature 938 (e.g., a barrier, a ridge, an isolation rail, etc.) is formed between the first and second recesses 928, 930, the second raised feature 940 is formed between the second and third recesses 930, 932 and the third raised feature 942 is formed between the third and fourth recesses 932, 934. In the illustrated example, the upper surface 926 of the printhead substrate 924 at the first, second and third raised features 938, 940, 942 is spaced from the lower surface 936 further than the upper surface 926 is spaced from top surfaces of the first and second printhead dies 920, 922. For example, similar to the printhead substrate 500 illustrated in FIGS. 5A and 5B, the top surfaces of the first and second printhead dies 920, 922 may be spaced from the lower surface 936 by the distance of $D_1$ and the upper surface 926 may be spaced from the lower surface 936 by a distance of $D_2$, which is greater than $D_1$. The example raised features 938, 940, 942 may define a guard rail and/or a ridge.

As illustrated in FIG. 9C, in some examples one or more radius(es) 927 may be formed on the edges of the printhead substrate 926 (e.g., on one or more of the edges of the upper surface 938 on the first, second and third raised features 938, 940, 942 and/or on one or more of the edges of the lower surface 936 in the first, second, third and fourth recesses 928, 930, 932, 934). For example, as illustrated in the enlarged view of FIG. 9C, the radius 927 is formed in the corner of the third recess 932 (FIG. 9D). Additionally or alternatively, in some examples one or more of the vertical walls in the carrier 900 include(s) the draft angle θ, which forms one or more corresponding draft angles on the vertical walls of the printhead substrate 926 (e.g., on the walls between the upper surface 938 of the first, second and third raised features 938, 940, 942 and the lower surface 936 of the first, second, third and fourth recesses 928, 930, 932, 934). In some examples, the carrier 900 may include more or fewer recesses and/or raised features to create more or less recesses and/or raised features in the corresponding printhead substrate. In some examples, the recesses and/or the raised features are different heights or distance than each other and, thus, may create different height raised features in the corresponding printhead substrate.

The example method 800 of FIG. 8 includes determining whether the printhead substrate 924 is completed (block 812). In some examples, one or more additional manufacturing or processing steps or operations may be performed on the printhead substrate (block 814). For example, one or more channels (e.g., passageway(s)) may be formed in the printhead substrate 924 to fluidly connect the first printhead die 920 to a fluid source (e.g., a first ink supply) and/or fluidly connect the second printhead die 922 to a fluid source (e.g., the first or a second ink supply). In some examples, the channels are formed via a laser process. In some examples, one or more slots may be formed in the printhead substrate 924 to provide passageway(s) for wires or other electrical connectors. In some examples, a PCB (e.g., the PCB 300 of FIG. 3) or a printed circuit assembly (PCA) is coupled to the printhead substrate 924. A PCB or PCA may be coupled to the printhead substrate via a PSA, for example. In some examples, the first printhead die 920 and/or the second printhead die 922 are coupled, via one or more wires, to the PCB or PCA (e.g., through one or more slots in the printhead substrate 924). In some examples, the ends of the first printhead die 920 and/or the ends of the second printhead die 922 may be encapsulated with a cover (e.g., the covers 208 of FIG. 2) to insulate any wires between the first printhead die 920 and the PCB or PCA and/or between the second printhead die 922 and the PCB or PCA. In some examples, the printhead substrate 924 may be formed as part of a mold panel having multiple printhead substrates that are formed simultaneously. As such, the mold panel may need to be singulated (e.g., cut and/or sized, separated, diced) into a smaller size to form the individual printhead substrate 924. In some examples, the printhead substrate 924 is tested for operability (e.g., via an E-test) and/or safety.

Figure 10:
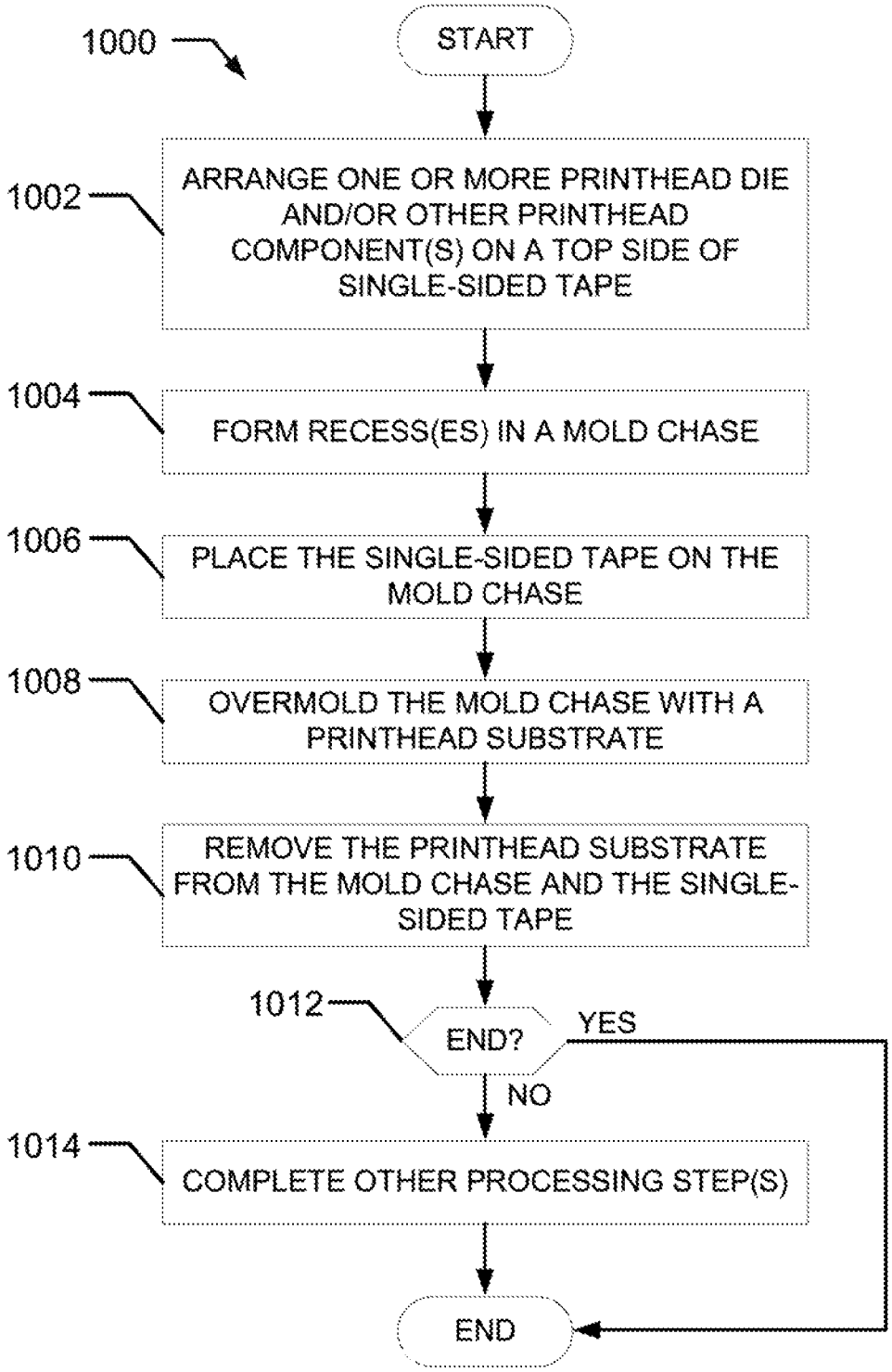
FIG. 10 is another flowchart representative of another example method of fabricating example printheads disclosed herein.

FIG. 10 is a flowchart representative of another example process or method 1000 that may be implemented to fabricate a printhead. The example method 1000 of FIG. 10 is described in combination with FIGS. 11A-11D, which show the resulting structure from executing corresponding phases of the example method 1000 of FIG. 10.

Figure 11A:
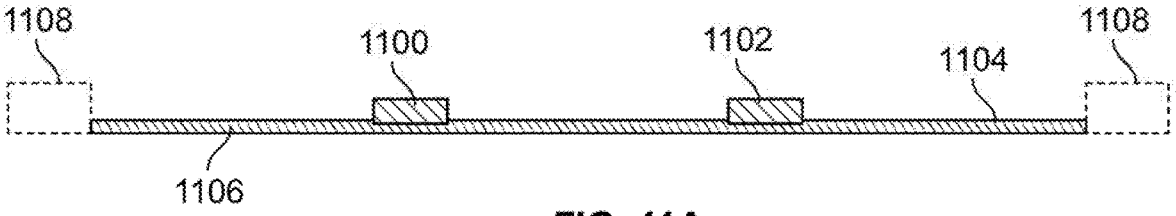
FIGS. 11A-11D illustrate an example printhead at various stages of fabrication in accordance with the example method of FIG. 10.

The example method 1000 of FIG. 10 includes arranging one or more printhead dies (e.g., a micro device, such as a MEMS device or sliver) and/or other printhead component(s) on a top side of a single-sided tape (block 1002). For example, as illustrated in FIG. 11A, a first printhead die 1100 and a second printhead die 1102 are arranged on a top surface 1104 of a single-sided tape 1106. In other examples, only one printhead die may be used or more than two printhead dies may be used. In some examples, the single-sided tape 1106 is coupled to a metal frame race 1108. The metal frame race 1108 is a frame that holds the edges of the single-sided tape 1106. While the metal frame race 1108 holds the single-sided tape 1106, the first printhead die 1100 and/or the second printhead die 1102 are arranged on the single-sided tape 1106. In the illustrated example, the top surface 1104 of the single-sided tape 1106 includes an adhesive. In the illustrated example of FIG. 11A, the first and second printhead dies 1100, 1102 are coupled to the top side 1104 of the single-sided tape 1106 by the adhesive, which maintains the first and second printhead dies 1100, 1102 in their desired positions.

The example method 1000 of FIG. 10 includes forming one or more recess(es) in a mold chase (e.g., a carrier, a metal mold, a steel cavity, etc.) (block 1004). The one or more recess(es) may be machined, for example, into the mold chase. For example, as illustrated in FIG. 11A, a mold chase 1112 is provided that has substantially the same recess configuration as the example carrier 900 of FIGS. 9A-9C. The example mold chase 1112 includes a first recess 1114, a second recess 1116 and a third recess 1118 formed (e.g., machined) in a top surface 1119 of the mold chase 1112, thereby forming a first raised area 1120 (e.g., a raised feature), a second raised area 1122, a third raised area 1124 and a fourth raised area 1126.

Figure 11B:
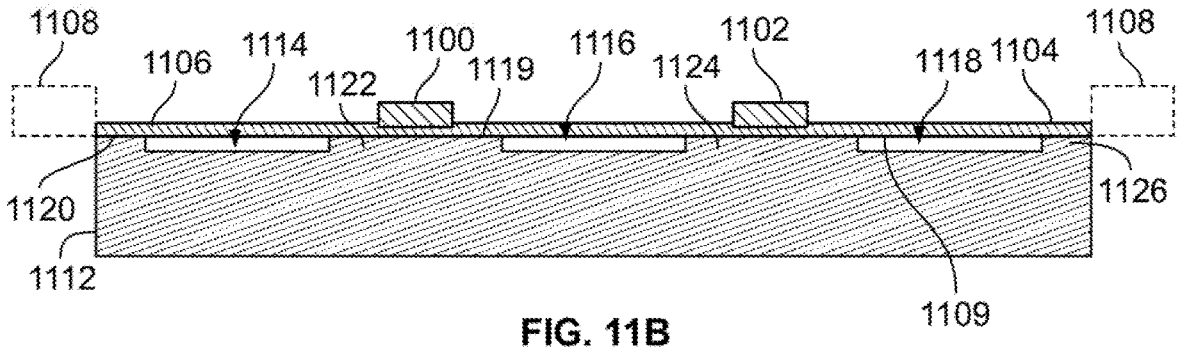

The example method 1000 of FIG. 10 includes placing the single-sided tape 1106 onto the mold chase 1112 (block 1006). For example, as illustrated in FIG. 11B, the single-sided tape 1106 is deposited (e.g., placed, laid) on the top surface 1119 of the mold chase 1112. In particular, a bottom side 1109 of the single-sided tape 1106 is placed in contact with the top surface 1119 of the mold chase 1112 (e.g., in contact with the first, second, third and fourth raise areas 1120, 1122, 1124, 1126). In some examples, the single-sided tape 1106 is moved by the metal frame race 1108 toward the mold chase 1112. The metal frame race 1108 may hold the single-sided tape 1106 between the molded chase 1112 and a upper mold chase, which are then closed to compress or overmold a printhead substrate. The metal frame race 1108 may be movable to move the single-sided tape up and down to deposit or release the single-sided tape 1106 from the mold chase 1112. In the illustrated example, the single-sided tape 1106 is flush across the top surface 1119 (and, thus, does not extend into the first, second and third recesses 1114, 1116, 118).

Figure 11C:
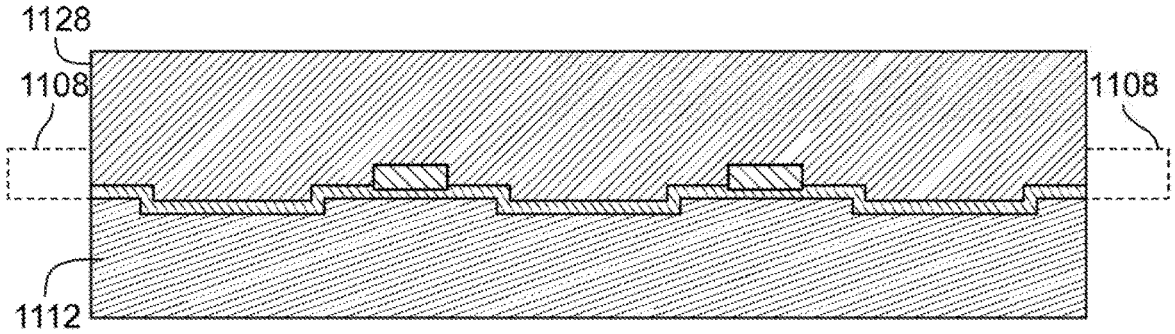
Figure 11D:
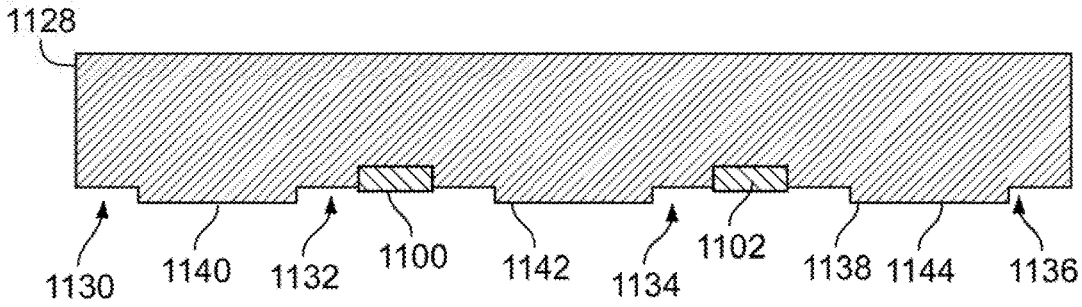

After the die(s) and/or corresponding component(s) are arranged on the mold chase 1112, the example method 1000 includes overmolding the mold chase 1112 with a printhead substrate 1128 (block 1008, FIG. 11C). The overmolding may be performed by closing the mold chase 1112 (e.g., by moving two sides of a mold (e.g., the mold chase 1112 and an upper mold) together with the printhead substrate 1128 and the single-sided tape 1106 therebetween). The printhead substrate 1128 may then be removed from the mold chase 1112 and the single-sided tape 1106 (block 1010, FIG. 11D). For example, the mold chase 1112 may be opened and the metal frame race 1108 may be moved away from the printhead substrate 1128 to release the single-sided tape from the printhead substrate 1128. As a result, the printhead substrate 1128 is compressed onto the mold chase 1112, thereby forming a first recess 1130, a second recess 1132, a third recess 1134 and a fourth recess 1136 in an upper surface 1138 of the printhead substrate 1128 and, thus, defining a first raised feature 1140 (e.g., a barrier, a ridge, an isolation rail, etc.), a second raised feature 1142 and a third raised feature 1144 to protect the first printhead die 1100 and the second printhead die 1102, as illustrated in FIG. 11D. The printhead substrate 1128 as illustrated in FIG. 11D is similar to the printhead substrate 926 illustrated in FIG. 9D. For example, similar to the printhead substrate 926, the example printhead substrate 1128 of FIG. 11D may be formed with one or more chamfer(s) or radius(es) (e.g., at one or more edges) and/or one or more vertical walls with draft angles θ.

The example method 1000 of FIG. 10 includes determining whether the printhead substrate 1128 is completed (block 1012) or whether one or more additional manufacturing or processing operations are to be performed on the printhead substrate 1128 (block 1014). The one or more additional processing operations may include any of the processes described in connection with block 814 of FIG. 8, for example.

Figure 12:
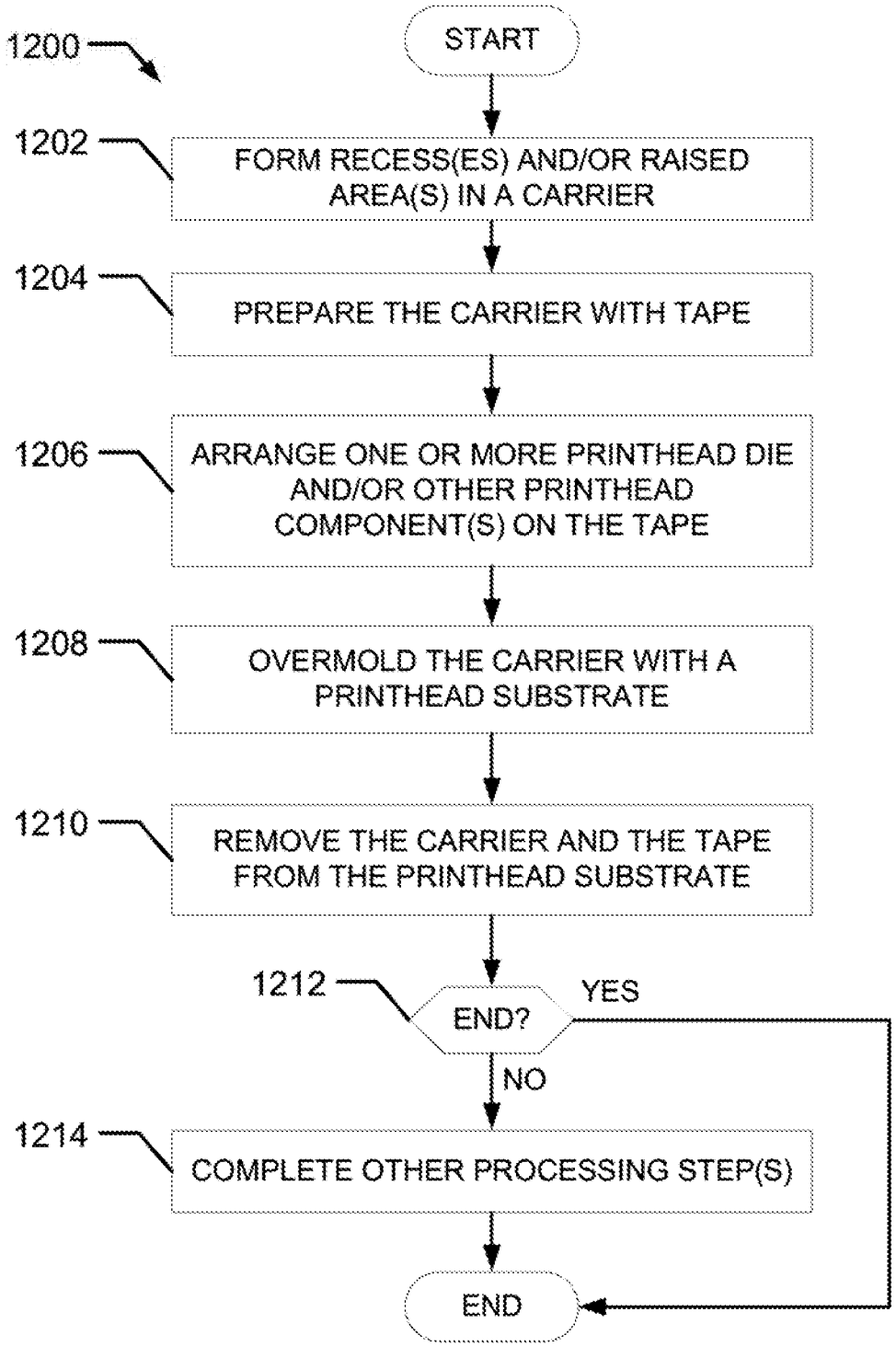
FIG. 12 is another flowchart representative of another example method of fabricating example printhead disclosed herein.

FIG. 12 is a flowchart representative of another example process or method 1200 that may be implemented to construct the example printheads disclosed herein. The example method 1200 of FIG. 12 is described in combination with FIGS. 13A-13D, which show the resulting structure from executing corresponding operations of the example method 1200 of FIG. 12. The example method 1200 may be used to construct a printhead having one or more recesses and/or one or more raised features such as, for example, those illustrated in the example printhead substrate 600 of FIGS. 6 and 7.

Figure 13A:
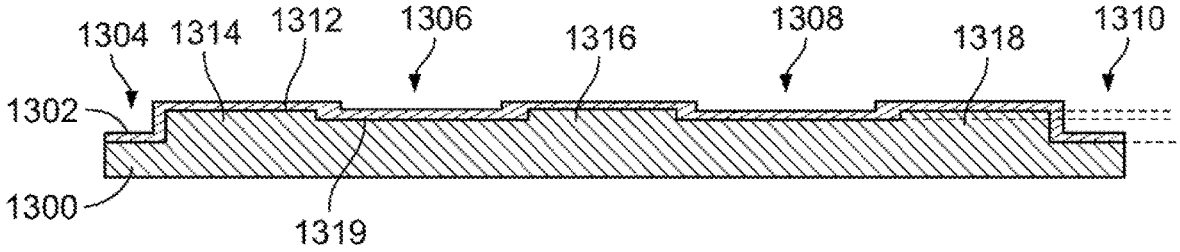
FIGS. 13A-13D illustrate an example printhead at various stages of fabrication in accordance with the example method of FIG. 12.

The example method 1200 of FIG. 12 includes forming one or more recess(es) and/or raised area(s) in a carrier 1300 (block 1202) and preparing a structured carrier 1300 with tape 1302 (block 1204) (see FIG. 13A). In the illustrated example, the example carrier 1300 includes a first recess 1304, a second recess 1306, a third recess 1308 and a fourth recess 1310 formed (e.g., machined) into a top surface 1312 of the carrier 1300. The first, second, third and fourth recesses 1304, 1306, 1308, 1310 may be used to form raised features (e.g., a guard rail, a ridge, an isolation rail, etc.) in a surface of a printhead substrate. In some examples, the first recess 1304, the second recess 1306, the third recess 1308 and/or the fourth recess 1310 are machined into the top surface 1312 of the carrier 1300. In the illustrated example, a first raised area 1314 (e.g., a first raised feature) is defined between the first recess 1304 and the second recess 1306, a second raised area 1316 is defined between the second recess 1306 and the third recess 1308, and a third raised area 1318 is defined between the third recess 1308 and the fourth recess 1310. In the illustrated example, the first recess 1304 and the fourth recess 1310 are deeper or extend into the top surface 1312 further than the second recess 1306 and the third recess 1308.

In the illustrated example, a bottom side 1319 of the tape 1302 is in contact with the top surface 1312 of the carrier 1300. The tape 1302 may be double-sided tape, such as disclosed in connection with the example method 800 of FIG. 8, or single-sided tape on a mold chase with one or more recess(es), such as disclosed in connection with the example method 1000 of FIG. 10. In other examples, other types of tape such as embossed type, multi-layer tape, etc. and/or any other adhesive structure may be implemented.

Figure 13B:
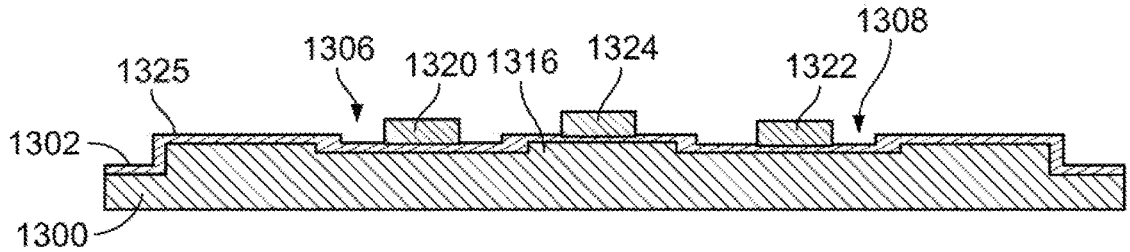

After the tape 1302 is positioned on the carrier 1300, one or more printhead dies (e.g., a micro device, such as a MEMS device or sliver) and/or other printhead component(s) (e.g., wiring, traces, covers, etc.) are positioned (e.g., arranged) on the laminate tape (block 1206). For example, as illustrated in FIG. 13B, a first printhead die 1320, a second printhead die 1322 and a third printhead die 1324 are arranged on the tape 1302. In the illustrated example, the first printhead die 1320 is placed onto a top side 1325 of the tape 1302 over the second recess 1306, the second printhead die 1322 is placed on the top side 1325 of the tape 1302 over the third recess 1308, and the third printhead die 1324 is placed on the top side 1325 of the tape 1302 over the second raised area 1316. In other examples, the first, second and/or third printhead dies 1320, 1322, 1324 may be placed in other locations. In some examples, more or fewer printhead dies are used.

Figure 13C:
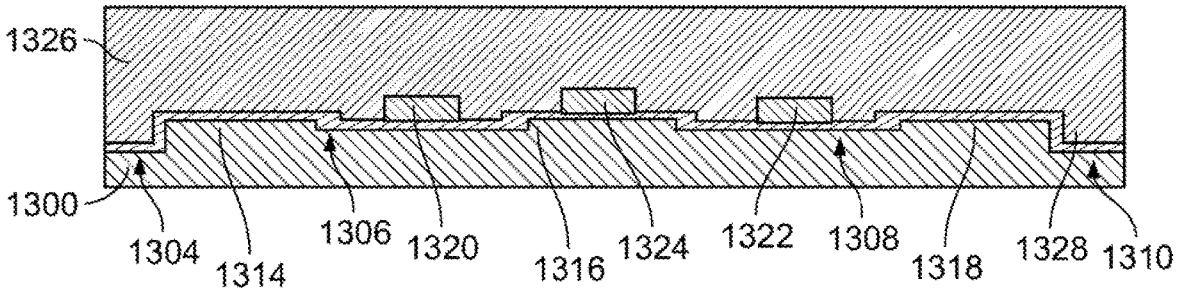

After the die(s) and/or corresponding component(s) are arranged on the tape 1302, the carrier 1300 is overmolded with a printhead substrate (block 1208). As illustrated in FIG. 13C, the carrier 1300 is overmolded by compressing a printhead substrate 1326 onto the carrier 1300 (e.g., in the direction of the top surface 1312 (FIG. 13A)). The compression process may be performed by applying high heat and/or high pressure. As illustrated in FIG. 13C, an upper surface 1328 of the printhead substrate 1326 contacts the top side 1325 of the tape 1302. As the printhead substrate 1326 is compressed, the upper surface 1328 of the printhead substrate 1326 moves into the first and fourth recesses 1304, 1310, and the first, second and third raised areas 1314, 1316, 1318 and the second and third recesses 1306, 1308 form corresponding recesses and raised features (e.g., a barrier, a ridge, an isolation rail, etc.) in the upper surface 1328 of the printhead substrate 1324. Additionally, the first, second and third printhead dies 1320, 1322, 1324 are pressed into the printhead substrate 1326. In some examples, prior to overmolding the printhead substrate 1326 at block 1208, the upper surface 1328 of the printhead substrate 1326 is substantially flat or planar.

Figure 13D:
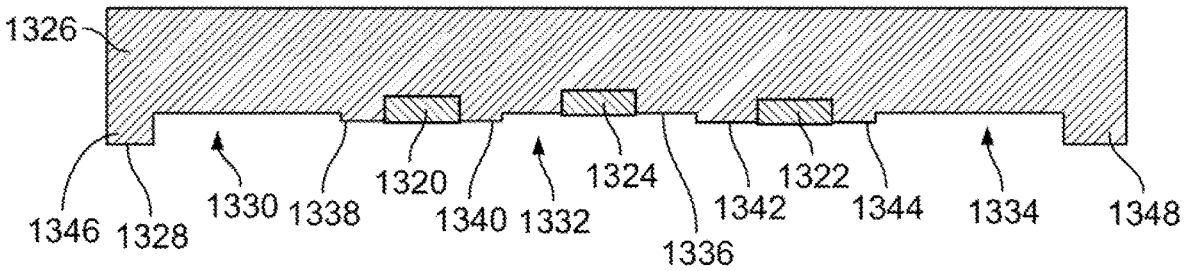

After the overmolding is complete (block 1208), the carrier 1300 and the tape 1302 are removed from the printhead substrate 1326 (block 1210). FIG. 13D illustrates the printhead substrate 1326 after the carrier 1300 and the tape 1302 have been removed. The first, second and third printhead dies 1320, 1322, 1324 remain coupled (e.g., molded into, embedded in) the printhead substrate 1326. In some examples, a heating process is used to release the carrier 1300 from the printhead substrate 1326. For example, the carrier 1300 may be heated to 180° C. for 90 seconds.

As shown in the illustrated example of FIG. 13D, the first, second and third raised areas 1314, 1316, 1318 of the carrier 1300 have formed corresponding first, second and third recesses 1330, 1332, 1334 in the upper surface 1328 of the printhead substrate 1326. The first, second and third recesses 1330, 1332, 1334 form a lower surface 1336. The lower surface 1336 is spaced below the upper surface 1328. In the illustrated example, the third printhead die 1324 is coupled to (e.g., molded into, embedded in) the lower surface 1336 in the second recess 1332. In the illustrated example, the second recess 1306 of the carrier 1300 formed a first ridge 1338 (e.g., a raised feature) between the first and second recesses 1330, 1332 in the printhead substrate 1326. The first printhead die 1320 is coupled to a first top surface 1340 of the first ridge 1338. Similarly, the third recess 1308 in the carrier 1300 formed a second ridge 1342 between the second and third recesses 1332, 1334 in the printhead substrate 1326. The second printhead die 1322 is coupled to a second top surface 1342 of the second ridge 1342.

In the illustrated example, a first barrier 1346 (e.g., a raised feature) is formed in the printhead substrate 1326 by the first recess 1304 of the carrier 1300. A barrier 1348 is formed in the printhead substrate 1326 by the fourth recess 1310 of the carrier 1300. The first and second barriers 1246, 1248 may be similar to the barrier 616 in the example printhead substrate 600 of FIGS. 6 and 7. The upper surface 1328 of the printhead substrate 1326, along the first and second barriers 1346, 1348, is spaced apart from the lower surface 1336 further than the upper surface 1328 is spaced apart from the top surfaces of the first, second and third printhead dies 1320, 1322, 1324. For example, similar to the example printhead substrate 600 illustrated in FIGS. 6 and 7, the first and second top surfaces 1340, 1344 of the respective first and second ridges 1338, 1342 may be spaced from the lower surface 1336 by the distance of $D_1$, and the top surfaces (e.g., faces) of the first and second printhead dies 1320, 1322 may be spaced from the respective first and second top surfaces 1340, 1344 by the distance of $D_2$. Therefore, the top surfaces of the first and second printhead dies 1220, 1222 are spaced from the lower surface 1336 a total distance of $D_1+D_2$. In the illustrated example, the upper surface 1328 (i.e., the top surface of the first and second barriers 1346, 1348) is spaced from the lower surface 1336 by the distance of $D_3$ (see FIG. 6), which is greater than the total distance of $D_1+D_2$. Further, the top surface of the third printhead die 1324 may be spaced from the lower surface 1336 by the distance of $D_4$ (see FIG. 7) which is less than the distance of $D_3$. Thus, the first and second barriers 1346, 1348 may protect the first, second and third printhead dies 1320, 1322, 1324 in the event the printhead substrate 1326 is placed face down (e.g., with the upper surface 1328 contacting a support surface). In some examples, similar to the example printhead substrate 924 of FIGS. 9C and 9D, the printhead substrate 1326 may be formed with one or more chamfer(s) or radius(es) (e.g., at one or more edges) and/or one or more vertical walls with draft angles θ.

The example method 1200 of FIG. 12 includes determining whether the printhead substrate 1326 is completed (block 1212) or whether one or more additional manufacturing or processing operations are to be performed on the printhead substrate 1326 (block 1214). The one or more additional processing operations may include any of the processes described in connection with block 814 of FIG. 8, for example.

From the foregoing, it will be appreciated that printheads, and methods of making the same, have been disclosed which achieve better protection of fragile printhead dies and other printhead components than known printheads. Some disclosed example printheads provide a barrier that surrounds a least a portion of a perimeter of an example printhead substrate and the printhead die(s) attached thereto. In some such examples, the barrier provides a sealing surface for which a cap and/or tape may be secured to seal and protect the example printhead during shipping and handling. The example recess(es) and/or raised feature(s) provide a relatively precise offset for protecting the printhead die(s).

While example printhead substrates and printhead dies disclosed herein are useful for inkjet printing, the teachings of this disclosure are not limited to inkjet printing. Instead, the teachings of this disclosure can be adapted to other forms of printing. Further, the teachings of this disclosure are not limited to ink dispensing, but can be adapted to other forms of fluid dispensing such as the dispensing of other printing fluids and/or other fluids for uses other than or in addition to printing.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A printhead comprising:
a substrate;
a printhead die disposed on a surface of the substrate, a top surface of the printhead die projecting a first distance from the surface of the substrate; and
a barrier formed on the substrate and at least partially surrounding the printhead die, a top surface of the barrier projecting a second distance from the surface of the substrate, the first distance being less than the second distance.

2. The printhead of claim 1, wherein the difference between the first distance and the second distance is about 10 micrometers to about 500 micrometers.

3. The printhead of claim 1, wherein the first printhead die is partially embedded in the substrate.

4. The printhead of claim 1, wherein the printhead die is a first printhead die, and further including:
a ridge extending from the substrate; and
a second printhead die disposed on the ridge, a top surface of the second printhead die spaced a third distance from the surface of the substrate, the third distance being less than the second distance.

5. The printhead of claim 4, wherein the first printhead die is a first microelectromechanical systems (MEMS) device and the second printhead die is a second MEMS device different than the first MEMS device.

6. The printhead of claim 1, further including a cap having a substantially flat bottom surface, when the cap is coupled to the top surface of the barrier, the bottom surface of the cap is spaced apart from the top surface of the printhead die.

7. A printhead comprising:
a substrate having a first recess and a second recess;
a first printhead die in the first recess;
a second printhead die in the second recess; and
a ridge located between the first recess and the second recess, the ridge to support the substrate on a surface while preventing the first and second printhead dies from contacting the surface.

8. The printhead of claim 7, wherein at least one of the first printhead die or the second printhead die is partially embedded in the substrate.

9. The printhead of claim 7, wherein the substrate includes a first channel extending from a bottom surface of the substrate to the first printhead die and a second channel extending from the bottom surface of the substrate to the second printhead die.

10. The printhead of claim 7, wherein the first printhead die is a first MEMS device and the second printhead die is a second MEMS device different than the first MEMS device.

11. The printhead of claim 7, wherein a top surface of the first printhead die is spaced below a top surface of the ridge by about 10 micrometers to about 500 micrometers.

* * * * *